US006070429A

United States Patent [19]

Low et al.

[11] Patent Number: 6,070,429

[45] Date of Patent: Jun. 6, 2000

[54] NITROGEN REJECTION SYSTEM FOR LIQUIFIED NATURAL GAS

[75] Inventors: William R. Low, Bartlesville, Okla.; Jame Yao, Sugar Land, Tex.

[73] Assignee: Phillips Petroleum Company, Bartlesville, Okla.

[21] Appl. No.: 09/281,024

[22] Filed: Mar. 30, 1999

[51] Int. Cl.[7] ..... F25J 3/00

[52] U.S. Cl. ..... 62/612; 62/619

[58] Field of Search ..... 62/612, 619

[56] References Cited

U.S. PATENT DOCUMENTS

| | | | |
|---|---|---|---|
| 3,342,037 | 9/1967 | Kniel | 62/612 |
| 3,413,816 | 12/1968 | De Marco | 62/612 |
| 3,596,472 | 8/1971 | Strelch et al. | 62/28 |
| 3,808,826 | 5/1974 | Harper | 62/612 |
| 3,818,714 | 6/1974 | Etzbach et al. | 62/612 |
| 3,855,810 | 12/1974 | Simon et al. | 62/612 |
| 3,874,184 | 4/1975 | Harper et al. | 62/28 |
| 3,929,438 | 12/1975 | Harper et al. | 62/612 |
| 4,172,711 | 10/1979 | Bailey | 62/612 |
| 4,225,329 | 9/1980 | Bailey et al. | 62/24 |
| 4,435,198 | 3/1984 | Gray | 62/28 |
| 4,680,041 | 7/1987 | DeLong | 62/11 |
| 4,698,080 | 10/1987 | Gray et al. | 62/612 |
| 5,036,671 | 8/1991 | Nelson et al. | 62/23 |
| 5,406,802 | 4/1995 | Forte | 62/17 |
| 5,421,165 | 6/1995 | Paradowski et al. | 62/24 |
| 5,505,049 | 4/1996 | Coyle et al. | 62/11 |
| 5,611,216 | 3/1997 | Low et al. | 62/612 |
| 5,669,234 | 9/1997 | Houser et al. | 62/612 |
| 5,737,940 | 4/1998 | Yao et al. | 62/620 |

*Primary Examiner*—Ronald Capossela
*Attorney, Agent, or Firm*—Gary L. Haag

[57] ABSTRACT

This invention concerns a method and an apparatus for removing nitrogen and other low boiling point inorganic components from pressurized LNG-bearing streams and streams produced therefrom. The removal of such components is accomplished via a novel pressure reduction/stripping methodology thereby producing at least one low BTU nitrogen-rich gas stream and at least one high BTU methane-rich stream which is suitable for recycle to an open methane cycle liquefaction process and/or employment as a high quality fuel gas.

48 Claims, 3 Drawing Sheets

NITROGEN REJECTION SYSTEM FOR LIQUIFIED NATURAL GAS

This invention concerns a method and an apparatus for removing nitrogen and other low boiling point inorganic components such as helium from pressurized LNG-bearing streams and streams produced therefrom. The removal of such components is accomplished via a novel pressure reduction/stripping methodology thereby producing at least one low BTU nitrogen-rich gas stream and at least one high BTU methane-rich stream which is suitable for recycle to an open methane cycle liquefaction process and/or employment as a high quality fuel gas.

BACKGROUND

The cryogenic liquefaction of natural gas is routinely practiced as a means of converting natural gas into a more convenient form for transportation and storage. Such liquefaction reduces the volume by about 600-fold and results in a product which can be stored and transported at near atmospheric pressure.

With regard to ease of storage, natural gas is frequently transported by pipeline from the source of supply to a distant market. It is desirable to operate the pipeline under a substantially constant and high load factor but often the deliverability or capacity of the pipeline will exceed demand while at other times the demand may exceed the deliverability of the pipeline. In order to shave off the peaks where demand exceeds supply or the valleys when supply exceeds demand, it is desirable to store the excess gas in such a manner that it can be delivered when the supply exceeds demand. Such practice allows future demand peaks to be met with material from storage. One practical means for doing this is to convert the gas to a liquefied state for storage and to then vaporize the liquid as demand requires.

The liquefaction of natural gas is of even greater importance when transporting gas from a supply source which is separated by great distances from the candidate market and a pipeline either is not available or is impractical. This is particularly true where transport must be made by ocean-going vessels. Ship transportation in the gaseous state is generally not practical because appreciable pressurization is required to significantly reduce the specific volume of the gas. Such pressurization requires the use of more expensive storage containers.

In order to store and transport natural gas in the liquid state, the natural gas is preferably cooled to −240° F. to −260° F. where the liquefied natural gas (LNG) possesses a near-atmospheric vapor pressure. Numerous systems exist in the prior art for the liquefaction of natural gas in which the gas is liquefied by sequentially passing the gas at an elevated pressure through a plurality of cooling stages whereupon the gas is cooled to successively lower temperatures until the liquefaction temperature is reached. Cooling is generally accomplished by heat exchange with one or more refrigerants such as propane, propylene, ethane, ethylene, methane, nitrogen or combinations of the preceding refrigerants (ex. mixed refrigerant systems). A liquefaction methodology which is particularly applicable to the current invention employs an open methane cycle for the final refrigeration cycle wherein a pressurized LNG-bearing stream is flashed and the flash vapors (i.e, the flash gas stream(s)) are subsequently employed as cooling agents, recompressed, cooled, combined with the processed natural gas feed stream and liquefied thereby producing the pressurized LNG-bearing stream.

In any liquefaction process producing a pressurized LNG-bearing stream, the presence of nitrogen and/or other low boiling point inorganic components such as helium is problematic because of the solubility of these components in pressurized LNG. Further, elevated concentrations of these components in the open methane cycle can increase refrigeration requirements and result in various operational problems. The removal of such components is required at some location in the process. One methodology for such removal has been to flash the pressurized LNG-bearing stream and employ the resulting flash gas stream(s) as fuel gas for drivers (ex. turbines) for refrigerant compressors employed in the liquefaction processes and/or electrical generators. However, the development of more environmentally-friendly turbines (ex. low NOX capability) has been accompanied by more stringent fuel gas requirements, most notably an increase in the minimal BTU content of the fuel gas. Therefore, conventional schemes for removing nitrogen from a liquefaction process via a fuel gas stream may no longer be practical when the BTU content of the flash gas stream(s) is too low for desired turbine operation. Further, fluctuations in fuel gas quality attributed to process upsets may render such conventional methodologies impractical. When there is little demand for fuel gas (ex. electric drivers are employed), the need to remove nitrogen from the liquefaction process in a manner which produces at least one low BTU nitrogen-rich gas stream which may be vented, used as a nitrogen source or used as a purge gas and at least one high BTU methane-rich gas stream which can be easily recycled to the liquefaction process becomes even more desirable.

SUMMARY OF THE INVENTION

It is an object of this invention to remove low boiling point inorganic components such as nitrogen from a pressurized LNG-bearing stream or a gas stream produced therefrom.

It is a further object of this invention to remove low boiling point inorganic components such as nitrogen from a pressurized LNG-bearing stream and in so doing, produce an LNG-bearing stream, a low BTU nitrogen-rich gas stream and one or more high BTU methane-rich gas streams.

It is a still further object of this invention to (1) remove low boiling point inorganic components such as nitrogen from a pressurized LNG-bearing stream thereby producing an LNG stream, a low BTU nitrogen-rich gas stream and one or more high BTU methane-rich gas streams and (2) recycle at least one of said high BTU methane-rich gas streams to the liquefaction process for liquefaction.

It is still yet a further object of this invention to (1) remove low boiling point inorganic components such as nitrogen from a pressurized LNG-bearing stream thereby producing an LNG stream, a low BTU nitrogen-rich gas stream and one or more high BTU methane-rich methane gas streams, (2) recycle at least one of said high BTU methane-rich gas streams to a liquefaction process from which the pressurized LNG-bearing stream is produced and (3) utilize another of the high BTU methane-rich gas streams as fuel gas for at least one compressor driver employed in the liquefaction process.

It is yet a further object of this invention to (1) remove low boiling point inorganic components such as nitrogen from a pressurized LNG-bearing stream thereby producing an LNG stream, a low BTU nitrogen-rich gas stream and one or more high BTU methane-rich gas streams, (2) recycle at least one of said methane-rich gas streams to the liquefaction process from which the pressurized LNG-bearing stream is produced, and (3) utilize another of the methane-rich gas streams as a fuel gas stream for the drivers employed in the refrigeration cycles in the liquefaction process and wherein at least one of said refrigeration cycles is an open methane cycle.

It is yet still a further object of this invention to (1) remove low boiling point inorganic components such as nitrogen from a pressurized LNG-bearing stream thereby producing an LNG stream, a low BTU nitrogen-rich gas stream and one or more high BTU methane-rich gas streams, (2) recycle at least two of said methane-rich gas streams to locations in the liquefaction process where the pressure and temperature of said streams are similar to those of the at least one of said methane-rich gas streams to the liquefaction process, and (3) utilize another of said high BTU methane-rich gas streams as a fuel gas stream for drivers employed in at least one of the refrigeration cycles in the liquefaction process and wherein at least one of said refrigeration cycles is an open methane cycle.

In one embodiment of this invention, a process has been discovered for removing low boiling point inorganic components such as nitrogen from a pressurized gas stream, where such gas stream is formed by the pressure reduction of a pressurized LNG-bearing stream and separation of the resulting stream into said pressurized gas stream and a liquid stream, comprising the steps of (a) splitting said gas stream into a first stream and a second stream, (b) cooling said first stream thereby producing a liquid-bearing stream, (c) contacting said liquid-bearing stream and second stream in a countercurrent, multistage manner thereby producing a first gas and a liquid stream, (d) splitting said first gas stream into a second gas stream and a third gas stream, (e) cooling and reducing the pressure of said second gas stream thereby producing a second liquid-bearing stream, (f) reducing the pressure of said third gas stream, (g) contacting said second liquid-bearing stream and reduced pressure third stream in a countercurrent, multistage manner thereby producing a fourth gas and a second liquid stream, (h) cooling and reducing the pressure of said fourth gas stream thereby producing a third liquid-bearing stream, (i) reducing the pressure of said second liquid stream, (j) contacting said third liquid-bearing stream and reduced pressure third liquid stream in a countercurrent, multistage manner thereby producing a fifth gas stream which is a low BTU nitrogen-rich gas stream and a third liquid stream which upon sufficient warming becomes a high BTU methane-rich gas stream, and (k) warming said fifth gas stream and third liquid stream wherein said inorganic component streams are employed as cooling agents for steps (e) and (h).

In another embodiment of this invention, an apparatus has been discovered for carry out the preceding process.

In yet another embodiment of this invention, a process for removing low boiling point inorganic components such as nitrogen from a pressurized LNG-bearing stream has been discovered comprising the steps of (a) splitting said stream into a first stream and a second stream, (b) cooling and reducing the pressure of said first stream, (c) reducing the pressure of said second stream, (d) contacting said cooled and reduced pressure first stream and reduced pressure second stream in a countercurrent, multistage manner thereby producing a first gas stream and a liquid stream, (e) splitting said first gas stream into a second gas stream and a third gas stream, (f) cooling and reducing the pressure of said second gas stream thereby producing a liquid-bearing stream, (g) reducing the pressure of said third gas stream, (h) contacting said liquid-bearing stream and reduced pressure third stream in a countercurrent, multistage manner thereby producing a fourth gas stream and a second liquid stream, (i) cooling and reducing the pressure of said fourth gas stream thereby producing a second liquid-bearing stream, (j) reducing the pressure of said second liquid stream, (k) contacting said second liquid-bearing stream and reduced pressure third liquid stream in a countercurrent, multistage manner thereby producing a fifth gas stream which is a low BTU nitrogen-rich gas stream and a third liquid stream which upon sufficient warming becomes a high BTU methane-rich gas stream, and (l) warming said fifth gas stream and third liquid stream wherein said streams are employed as cooling agents for steps (f) and (i).

And in yet still another embodiment of this invention, an apparatus has been discovered for carry out the preceding process.

DESCRIPTION OF THE PREFERRED EMBODIMENTS

Figure 1:
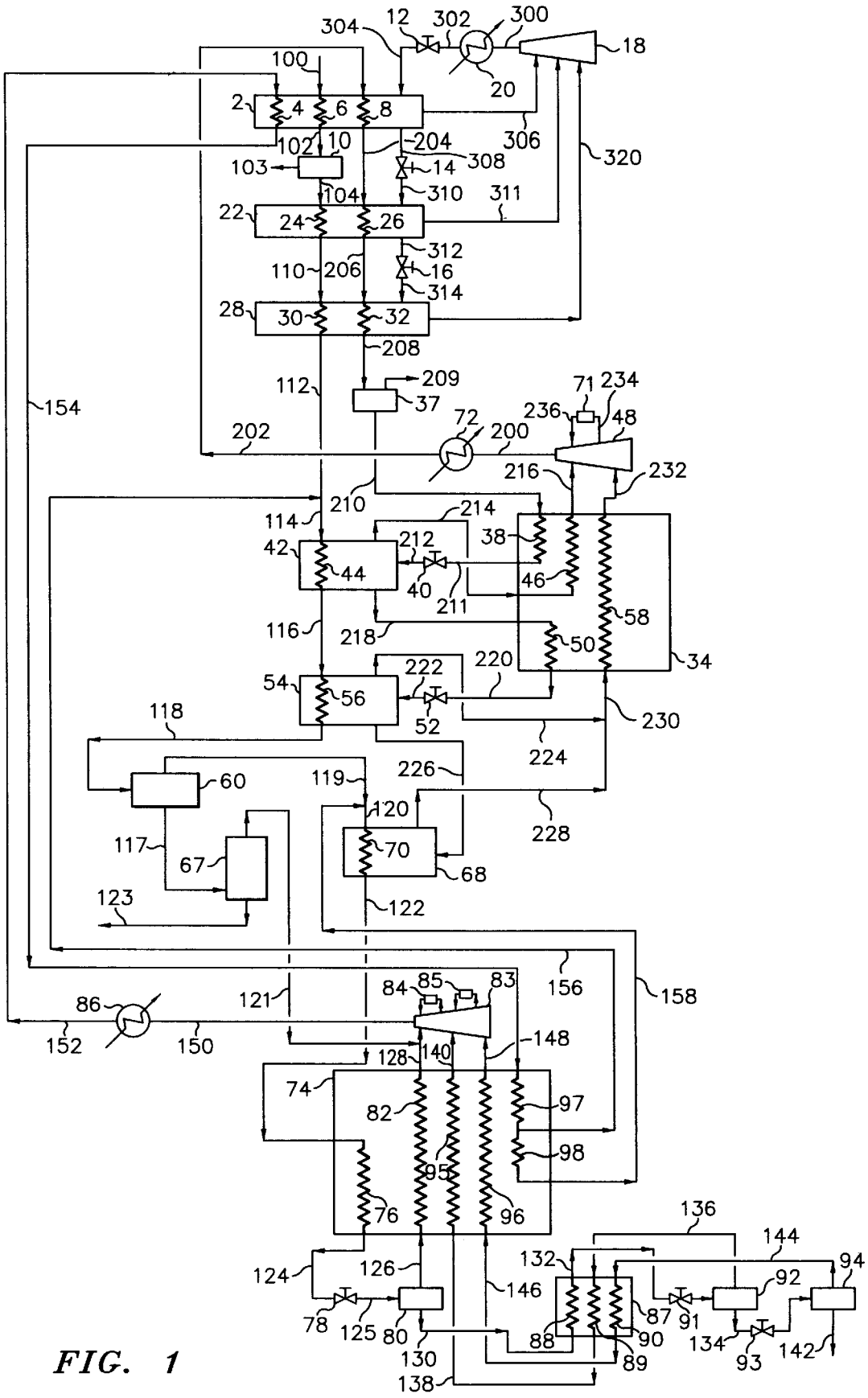
FIG. 1 is a simplified flow diagram of a cascaded refrigeration process for LNG production which employs an open methane refrigeration cycle.

For the purposes of the ensuing process description, natural gas feed stream refers to the natural gas stream delivered to the LNG plant. Processed natural gas feed stream refers to the natural gas stream which has undergone some degree of processing for the removal of inorganic contaminants and/or heavier hydrocarbon species. Pressurized LNG-bearing stream refers to a pressurized stream which is comprised in the majority of liquefied natural gas (LNG). LNG-bearing stream will refer to a liquefied natural gas stream at near ambient pressure which is comprised in major portion of LNG. LNG stream refers to an LNG-bearing stream which consists essentially of LNG.

Flash gas streams refers to the vapor and/or gas phase streams generated when the pressure of a pressurized LNG-bearing stream is reduced and the stream separated into a second pressurized LNG-bearing stream or an LNG-bearing stream and a vapor and/or gas phase stream. Processed flash gas stream refers to a flash stream which has undergone processing for the removal of nitrogen and/or other inorganic components.

Open methane cycle gas stream refers to a flash gas stream or a processed flash stream which is returned to the methane compressors in the open methane cycle. Compressed methane cycle gas stream refers to an open methane cycle gas stream which has undergone compression in a methane compressor. Liquefaction stream refers to the stream obtained upon combining the processed natural gas feed stream with at least one compressed methane cycle gas stream. Fuel gas stream refers to a gas stream which is employed as a fuel for turbine drivers in the LNG plant.

A low BTU nitrogen-rich gas stream is a stream comprised in major portion of nitrogen and optionally, other inorganic components such as helium, where said stream preferably possesses a lower heating value of less than about 500 BTU/SCF, more preferably less than about 350 BTU/SCF, still more preferably less than about 100 BTU/SCF, still yet more preferably less than about 50 BTU/SCF and most preferably less than about 10 BTU/SCF. The combined nitrogen and other inorganic components in this stream is preferably greater than about 65 mol %, more preferably greater than about 90 mol %, still more preferably greater than about 95 mol % and most preferably greater than about 99 mol %. A high BTU methane-rich gas stream is a stream comprised in major portion of methane and other organic compounds which preferably possesses a lower BTU heating value of greater than about 750 BTU/SCF, preferably greater than about 800 BTU/SCF which is a nominal heating value for certain environmentally friendly turbine drivers, and still more preferably greater than about 950 BTU/SCF. The methane content of this stream is preferably greater than about 75 mol %, more preferably greater than about 85 mol % and most preferably greater than about 95 mol %.

Natural Gas Liquefaction via a Cascade Refrigeration Process

While certain embodiments of the present invention are applicable to the generic removal of low boiling point inorganic components from pressurized LNG-bearing streams, the preferred embodiments particularly concern nitrogen removal from pressurized LNG-bearing streams or streams produced therefrom and the recycling of processed flash streams to an open-cycle cascaded refrigeration process. Low boiling point inorganic components are defined to be those inorganic components found in natural gas which possess boiling points similar to or less than methane. The most preferred low boiling point inorganic component in the practice of this invention is nitrogen. The other most common low boiling point inorganic component in pressurized LNG-bearing streams is helium. As previously noted, the invention in its preferred embodiments allows for (1) the recycling of certain of the high BTU methane-rich gas streams produced from the nitrogen removal process to the liquefaction process, (2) the optional production of one or more high BTU methane-rich fuel gas streams, and the (3) removal of nitrogen from the liquefaction process via a low BTU nitrogen-rich gas stream which is predominantly nitrogen and which may be vented to the atmosphere, employed as a nitrogen source or function as purge gas.

As used herein, the term open-cycle cascaded refrigeration process refers to a cascaded refrigeration process comprising at least one closed refrigeration cycle and one open refrigeration cycle where the boiling point of the refrigerant/cooling agent employed in the open cycle is less than the boiling point of the refrigerating agent or agents employed in the closed cycle(s) and a portion of the cooling duty to condense the compressed open-cycle refrigerant/cooling agent is provided by one or more of the closed cycles. In the current invention, methane or a predominately methane stream is employed as the refrigerant/cooling agent in the open cycle. This stream is comprised of the processed natural gas feed stream and the compressed open methane cycle gas streams. The compressed open methane cycle gas streams may be comprised in part from streams from the nitrogen rejection process.

The design of a cascaded refrigeration process involves a balancing of thermodynamic efficiencies and capital costs. In heat transfer processes, thermodynamic irreversibilities are reduced as the temperature gradients between heating and cooling fluids become smaller, but obtaining such small temperature gradients generally requires significant increases in the amount of heat transfer area, major modifications to various process equipment and the proper selection of flowrates through such equipment so as to ensure that both flowrates and approach and outlet temperatures are compatible with the required heating/cooling duty.

In a similar manner and of particular relevance to the current invention, thermodynamic irreversibilities associated with the return of recycle streams to the liquefaction process can be reduced by combining streams which possess similar temperatures and pressures. Therefore, the manner in which the nitrogen removal and natural gas liquefaction methodologies (i.e., strive to minimize irreversibilities associated with the mixing of streams) are integrated can significantly affect the overall process efficiency.

One of the most efficient and effective means of liquefying natural gas is via an optimized cascade-type operation in combination with expansion-type cooling. Such a liquefaction process is comprised of the sequential cooling of a natural gas stream at an elevated pressure, for example about 625 psia, by sequentially cooling the gas stream by passage through a multistage propane cycle, a multistage ethane or ethylene cycle and an open-end methane cycle which utilizes a portion of the feed gas as a source of methane and which includes therein a multistage expansion cycle to further cool the same and reduce the pressure to near-atmospheric pressure. In the sequence of cooling cycles, the refrigerant having the highest boiling point is utilized first followed by a refrigerant having an intermediate boiling point and finally by a refrigerant having the lowest boiling point.

Pretreatment steps provide a means for removing undesirable components such as acid gases, mercaptan, mercury and moisture from the natural gas feed stream delivered to the facility. The composition of this gas stream may vary significantly. As used herein, a natural gas stream is any stream principally comprised of methane which originates in major portion from a natural gas feed stream, such feed stream for example containing at least 85% by volume, with the balance being ethane, higher hydrocarbons, nitrogen, carbon dioxide and a minor amounts of other contaminants such as mercury, hydrogen sulfide, and mercaptan. The pretreatment steps may be separate steps located either upstream of the cooling cycles or located downstream of one of the early stages of cooling in the initial cycle. The following is a non-inclusive listing of some of the available means which are readily available to one skilled in the art. Acid gases and to a lesser extent mercaptan are routinely removed via a sorption process employing an aqueous amine-bearing solution. This treatment step is generally performed upstream of the cooling stages in the initial cycle. A major portion of the water is routinely removed as a liquid via two-phase gas-liquid separation following gas compression and cooling upstream of the initial cooling cycle and also downstream of the first cooling stage in the initial cooling cycle. Mercury is routinely removed via mercury sorbent beds. Residual amounts of water and acid gases are routinely removed via the use of properly selected sorbent beds such as regenerable molecular sieves. Processes employing sorbent beds are generally located downstream of the first cooling stage in the initial cooling cycle.

The processed natural gas feed stream is generally delivered to the liquefaction process at an elevated pressure or is compressed to an elevated pressure, that being a pressure greater than 500 psia, preferably about 500 psia to about 900 psia, still more preferably about 500 psia to about 675 psia, still yet more preferably about 600 psia to about 675 psia, and most preferably about 625 psia. The stream temperature is typically near ambient to slightly above ambient. A representative temperature range being 60 F to 120 F.

As previously noted, the natural gas feed stream is cooled in a plurality of multistage (for example, three) cycles or steps by indirect heat exchange with a plurality of refrigerants, preferably three. The overall cooling efficiency for a given cycle improves as the number of stages increases but this increase in efficiency is accompanied by corresponding increases in net capital cost and process complexity. The feed gas is preferably passed through an effective number of refrigeration stages, nominally 2, preferably two to four, and more preferably three stages, in the first closed refrigeration cycle utilizing a relatively high boiling refrigerant. Such refrigerant is preferably comprised in major portion of propane, propylene or mixtures thereof, more preferably propane, and most preferably the refrigerant consists essentially of propane. Thereafter, the processed feed gas flows through an effective number of stages, nominally two, preferably two to four, and more preferably two or three, in a second closed refrigeration cycle in heat exchange with a refrigerant having a lower boiling point. Such refrigerant is preferably comprised in major portion of ethane, ethylene or mixtures thereof, more preferably ethylene, and most preferably the refrigerant consists essentially of ethylene. Each cooling stage comprises a separate cooling zone. As previously noted, the processed natural gas feed stream is combined with one or more recycle streams (i.e., compressed open methane cycle gas streams) at various locations in the second cycle thereby producing a liquefaction stream. In the last stage of the second cooling cycle, the liquefaction stream is condensed (i.e., liquefied) in major portion, preferably in its entirety thereby producing a pressurized LNG-bearing stream. Generally, the process pressure at this location is only slightly lower than the pressure of the feed gas to the first stage of the first cycle.

Generally, the natural gas feed stream will contain such quantities of $C_2$+ components so as to result in the formation of a $C_2$+ rich liquid in one or more of the cooling stages. This liquid is removed via gas-liquid separation means, preferably one or more conventional gas-liquid separators. Generally, the sequential cooling of the natural gas in each stage is controlled so as to remove as much as possible of the $C_2$ and higher molecular weight hydrocarbons from the gas to produce a gas stream predominating in methane and a liquid stream containing significant amounts of ethane and heavier components. An effective number of gas/liquid separation means are located at strategic locations downstream of the cooling zones for the removal of liquids streams rich in $C_2$+ components. The exact locations and number of gas/liquid separation means, preferably conventional gas/liquid separators, will be dependant on a number of operating parameters, such as the $C_2$+ composition of the natural gas feed stream, the desired BTU content of the LNG product, the value of the $C_2$+ components for other applications and other factors routinely considered by those skilled in the art of LNG plant and gas plant operation. The $C_2$+ hydrocarbon stream or streams may be demethanized via a single stage flash or a fractionation column. In the latter case, the resulting methane-rich stream can be directly returned at pressure to the liquefaction process. In the former case, this methane-rich stream can be repressurized and recycle or can be used as fuel gas. The $C_2$+ hydrocarbon stream or streams or the demethanized $C_2$+ hydrocarbon stream may be used as fuel or may be further processed such as by fractionation in one or more fractionation zones to produce individual streams rich in specific chemical constituents (ex., $C_2$, $C_3$, $C_4$ and $C_5$+).

The pressurized LNG-bearing stream is then further cooled in a third cycle or step referred to as the open methane cycle via contact in a main methane economizer with flash gases (i.e., flash gas streams) generated in this third cycle in a manner to be described later and via expansion of the pressurized LNG-bearing stream to near atmospheric pressure. During this expansion, the pressurized LNG-bearing stream is cooled via at least one, preferably two to four, and more preferably three expansions where each expansion employs as a pressure reduction means either Joule-Thomson expansion valves or hydraulic expanders. The expansion is followed by a separation of the gas-liquid product with a separator. When a hydraulic expander is employed and properly operated, the greater efficiencies associated with the recovery of power, a greater reduction in stream temperature, and the production of less vapor during the flash step will frequently more than off-set the more expensive capital and operating costs associated with the expander. In one embodiment, additional cooling of the pressurized LNG-bearing stream prior to flashing is made possible by first flashing a portion of this stream via one or more hydraulic expanders and then via indirect heat exchange means employing said flash gas stream to cool the remaining portion of the pressurized LNG-bearing stream prior to flashing. The warmed flash gas stream is then recycled via return to an appropriate location, based on temperature and pressure considerations, in the open methane cycle and will be recompressed.

When the pressurized LNG-bearing stream, preferably a liquid stream, entering the third cycle is at a preferred pressure of about 600 psia, representative flash pressures for a three stage flash process are about 190, 61 and 24.7 psia. Streams generated in the nitrogen removal step to be described may be utilized in the main methane economizer to cool the pressurized LNG-bearing stream from the second refrigeration cycle prior to expansion and are used to cool the compressed open methane cycle stream. The inventive means and associated apparatus for recycling the flash gas streams will be discussed in a later section. Flashing of the pressurized LNG-bearing stream, preferably a liquid stream, to near atmospheric pressure produces an LNG product possessing a temperature of −240° F. to −260° F.

Refrigerative Cooling for Natural Gas Liquefaction

Critical to the liquefaction of natural gas in a cascaded process is the use of one or more refrigerants for transferring heat energy from the natural gas stream to the refrigerant and ultimately transferring said heat energy to the environment. In essence, the overall refrigeration system functions as a heat pump by removing heat energy from the natural gas stream as the stream is progressively cooled to lower and lower temperatures.

The inventive process may use one of several types of cooling which include but is not limited to (a) indirect heat exchange, (b) vaporization and (c) expansion or pressure reduction. Indirect heat exchange, as used herein, refers to a process wherein the refrigerant cools the substance to be cooled without actual physical contact between the refrigerating agent and the substance to be cooled. Specific examples of indirect heat exchange means include heat exchange undergone in a shell-and-tube heat exchanger, a core-in-kettle heat exchanger, and a brazed aluminum plate-fin heat exchanger. The physical state of the refrigerant and substance to be cooled can vary depending on the demands of the system and the type of heat exchanger chosen. Thus, in the inventive process, a shell-and-tube heat exchanger will typically be utilized where the refrigerating agent is in a liquid state and the substance to be cooled is in a liquid or gaseous state or when one of the substances undergoes a phase change and process conditions do not favor the use of a core-in-kettle heat exchanger. As an example, aluminum and aluminum alloys are preferred materials of construction for the core but such materials may not be suitable for use at the designated process conditions. A plate-fin heat exchanger will typically be utilized where the refrigerant is in a gaseous state and the substance to be cooled is in a liquid or gaseous state. Finally, the core-in-kettle heat exchanger will typically be utilized where the substance to be cooled is liquid or gas and the refrigerant undergoes a phase change from a liquid state to a gaseous state during the heat exchange.

Vaporization cooling refers to the cooling of a substance by the evaporation or vaporization of a portion of the substance with the system maintained at a constant pressure. Thus, during the vaporization, the portion of the substance which evaporates absorbs heat from the portion of the substance which remains in a liquid state and hence, cools the liquid portion.

Finally, expansion or pressure reduction cooling refers to cooling which occurs when the pressure of a gas, liquid or a two-phase system is decreased by passing through a pressure reduction means. In one embodiment, this expansion means is a Joule-Thomson expansion valve. In another embodiment, the expansion means is either a hydraulic or gas expander. Because expanders recover work energy from the expansion process, lower process stream temperatures are possible upon expansion.

In the discussion and drawings to follow, the discussions or drawings may depict the expansion of a stream by flowing through a throttle valve followed by a subsequent separation of gas and liquid portions in the refrigerant chillers wherein indirect heat-exchange also occurs. While this simplified scheme is workable and sometimes preferred because of cost and simplicity, it may be more effective to carry out expansion and separation and then partial evaporation as separate steps, for example a combination of throttle valves and flash drums prior to indirect heat exchange in the chillers. In another workable embodiment, the throttle or expansion valve may not be a separate item but an integral part of the vessel to which said liquid-bearing or liquid stream is introduced (i.e., the pressure reduction or flash occurs upon entry of the liquid-bearing or liquid stream into the vessel of interest).

In the first cooling cycle or step, cooling is provided by the compression of a higher boiling point gaseous refrigerant, preferably propane, to a pressure where it can be liquefied by indirect heat transfer with a heat transfer medium which ultimately employs the environment as a heat sink, that heat sink generally being the atmosphere, a fresh water source, a salt water source, the earth or a two or more of the preceding. The condensed refrigerant then undergoes one or more steps of expansion cooling via suitable expansion means thereby producing two-phase mixtures possessing significantly lower temperatures. In one embodiment, the main stream is split into at least two separate streams, preferably two to four streams, and most preferably three streams where each stream is separately expanded to a designated pressure. Each stream then provides vaporative cooling via indirect heat transfer with one or more selected streams, one such stream being the natural gas stream to be liquefied. The number of separate refrigerant streams will correspond to the number of refrigerant compressor stages. The vaporized refrigerant from each respective stream is then returned to the appropriate stage at the refrigerant compressor (e.g., two separate streams will correspond to a two-stage compressor). In a more preferred embodiment, all liquefied refrigerant is expanded to a predesignated pressure and this stream then employed to provide vaporative cooling via indirect heat transfer with one or more selected streams, one such stream being the natural gas stream to be liquefied. A portion of the liquefied refrigerant is then removed from the indirect heat exchange means, expansion cooled by expanding to a lower pressure and correspondingly lower temperature where it provides vaporative cooling via indirect heat exchange means with one or more designated streams, one such stream being the natural gas stream to be liquefied. Nominally, this embodiment will employ two such expansion cooling/vaporative cooling steps, preferably two to four, and most preferably three. Like the first embodiment, the refrigerant vapor from each step is returned to the appropriate inlet port at the staged compressor.

In a cascaded refrigeration system, a significant portion of the cooling for liquefaction of the lower boiling point refrigerants (i.e., the refrigerants employed in the second and third cycles) is made possible by cooling these streams via indirect heat exchange with selected higher boiling refrigerant streams. This manner of cooling is referred to as "cascaded cooling." In effect, the higher boiling refrigerants function as heat sinks for the lower boiling refrigerants or stated differently, heat energy is pumped from the natural gas stream to be liquefied to a lower boiling refrigerant and is then pumped (i.e., transferred) to one or more higher boiling refrigerants prior to transfer to the environment via an environmental heat sink (ex., fresh water, salt water, atmosphere). As in the first cycle, refrigerant employed in the second and third cycles are compressed via compressors, preferably multi-staged compressors, to preselected pressures. When possible and economically feasible, the compressed refrigerant vapor is first cooled via indirect heat exchange with one or more cooling agents (ex., air, salt water, fresh water) directly coupled to environmental heat sinks. This cooling may be via inter-stage cooling between compression stages or cooling of the fully compressed refrigerant. The compressed stream is then further cooled via indirect heat exchange with one or more of the previously discussed cooling stages for the higher boiling point refrigerants. As used herein, compressor shall refer to compression equipment associated with all stages of compression and any equipment associated with inter-stage cooling.

The second cycle refrigerant, preferably ethylene, is preferably first cooled after compression via indirect heat exchange with one or more cooling agents directly coupled to an environmental heat sink (i.e., inter-stage and/or post-cooling following compression) and then further cooled and finally liquefied via sequentially contacted with the first and second or first, second and third cooling stages for the highest boiling point refrigerant which is employed in the first cycle. The preferred second and first cycle refrigerants are ethylene and propane, respectively.

In the open-cycle portion of the cascaded refrigeration system such as illustrated in FIG. 1, cooling occurs by (1) subcooling the pressurized LNG-bearing stream prior to flashing by contacting via indirect heat exchange means said stream, preferably a liquid stream, with downstream flash vapors (i.e., flash gas streams) and (2) cooling the compressed open methane cycle gas stream by contacting via indirect heat exchange means said stream with said flash vapors. As just noted, the pressurized LNG-bearing stream, preferably a liquid stream, from the second cycle is first cooled in the open or third cycle via indirect contact with one or more flash gas streams from subsequent flash steps followed by the subsequent pressure reduction of the cooled stream. The pressure reduction is conducted in one or more discrete steps. In each step, significant quantities of methane-rich vapor at a given pressure are produced. Each flash gas stream preferably undergoes significant heat transfer in the methane economizers via indirect heat exchange with the pressurized LNG-bearing stream about to be flashed and/or the compressed open methane cycle gas stream. Said warmed flash gases are preferably returned to the inlet port of a compressor stage at near-ambient temperatures. In the course of flowing through the methane economizers, the flash gas streams are preferably contacted with streams to be cooled in a generally countercurrent manner, preferably a countercurrent manner, and in a sequence designed to maximize the cooling of the streams to be cooled. The pressure selected for each stage of expansion cooling is such that for each stage, the volume of gas generated by the expansion plus the volume of any returned processed flash gas streams plus the compressed volume of gas from the adjacent lower stage results in efficient overall operation of the multi-stage compressor.

The warmed flash gas streams (i.e., an open methane cycle gas stream) are returned, preferably at near-ambient temperature, to the inlet ports of the compressor whereupon these streams are compressed to a pressure such that they can be combined with the main process stream prior to liquefaction. Interstage cooling and cooling of the compressed open methane cycle gas stream is preferred and preferably accomplished via indirect heat exchange with one or more cooling agents directly coupled to an environment heat sink. The compressed open methane cycle gas stream is then further cooled via indirect heat exchange with refrigerant in the first and second cycles, preferably the first cycle refrigerant in all stages, more preferably the first two stages and most preferably, the first stage. The cooled compressed open methane cycle gas stream is further cooled via indirect heat exchange with flash gas streams in the main methane economizer and is then combined with the processed natural gas feed stream in the manner described in the next section.

Optimization via Inter-stage and Inter-cycle Heat Transfer

Returning the refrigerant gas streams to their respective compressors at or near ambient temperature is favored. Not only does this step improve overall efficiencies, but difficulties associated with the exposure of compressor components to cryogenic conditions are greatly reduced. This is accomplished via the use of economizers wherein pressurized LNG-bearing streams comprised in major portion of LNG prior to flashing and the compressed open methane cycle gas stream is cooled by indirect heat exchange with one or more flash gas streams generated in a downstream expansion step (i.e., stage) or steps in the same or a downstream cycle and/or processed flash gas streams. As an example, the flash gas stream in the open or third cycle preferably flow through one or more economizers where (1) these streams cool via indirect heat exchange the pressurized LNG-bearing streams prior to each pressure reduction stage and (2) these streams cool via indirect heat exchange the compressed open methane cycle gas stream prior to recycling and combination with the processed natural gas stream. These cooling steps will be discussed in greater detail in the discussion of FIG. 1. In one embodiment wherein ethylene and methane are employed in the second and open (third) cycles respectively, the contacting can be performed via a series of ethylene and methane economizers. In the preferred embodiment which is illustrated in FIG. 1 and which will be discuss in greater detail later, there is a main ethylene economizer, a main methane economizer and one or more additional methane economizers. These additional economizers are referred to herein as the second methane economizer, the third methane economizer and so forth and each additional methane economizer corresponds to a separate downstream flash step.

As previously noted, significant improvements in process efficiencies are possible by the manner in which the compressed open methane cycle gas stream (also referred to as the recycle stream) is cooled prior to combining with the processed natural gas feed stream. Process efficiency can be improved by using the flash gas streams to cool the compressed open methane cycle gas stream or a portion thereof prior to combining such stream with the processed natural gas feed stream. Such cooling also allows the flash gas stream to be returned to the compressor at near ambient temperatures. The compressed open methane cycle gas stream may be cooled in its entirety and combined with the processed natural gas feed stream in the second cycle immediately upstream of the condenser wherein the resulting liquefaction stream is condensed in major portion. A preferred methodology is to selectively cool the compressed open methane cycle gas stream in such a manner that two or more return streams of different temperatures are produced and such return streams are subsequently combined with the processed natural gas feed stream or resulting liquefaction stream in the cascaded refrigeration process at locations where the respective stream temperatures are similar. The partitioning of the compressed open methane cycle gas stream into two to four return streams is preferred and two to three return streams are more preferred. Because of the resulting increase in process efficiency and relatively small increase in capital cost and process complexity, the most preferred methodology is partitioning or splitting of the recycle stream into two return streams. For two return streams, each stream is preferably comprised of 20 to 80% of the recycle stream, more preferably 25 to 75%, and most preferably about 50%. When the closed refrigeration cycle immediately upstream of the open cycle consists of two or three stages, the most preferred configuration to employ two return streams at respective locations which are upstream of the first stage chiller and upstream of the last stage condenser (i.e., immediately upstream of the chiller wherein the combined process stream is liquefied in major portion).

The pressure of the liquefaction stream is preferably greater than 500 psia, more preferably greater than about 500 psia to 900 psia, still more preferably about 500 psia to about 675 psia, still yet more preferably about 600 psia to about 675 psia, and most preferably about 625 psia. As previously noted, the closed refrigeration cycle preferably employs a refrigerant comprised in a major portion of ethylene, ethane or a mixture thereof. Also as previously noted, it is preferred that an additional refrigeration cycle be employed whose primary function is to precool the natural gas feed stream. Preferably, the refrigerant employed in this closed cycle is comprised of propane in major portion and in a preferred embodiment, this cycle is also employed for cooling the compressed open methane cycle gas stream prior to cooling via indirect heat exchange means with the flash gas streams. This refrigeration cycle also provides cooling duty to condense the compressed vapors in the cycle immediately upstream of the open cycle and therefore, the respective cycles are cascaded.

When liquefying natural gas at a process pressure of about 500 psia to about 675 psia, the preferred pressure following a single pressure reduction step is about 15 psia to about 30 psia. When employing the more preferred two-stage pressure reduction procedure, preferred pressures following pressure reduction are about 150 psia to about 250 psia for the first stage of reduction and about 15 psia to about 30 psia for the second stage. When employing the most preferred three-stage pressure reduction procedure, a pressure of the about 150 to about 250 psia is preferred for the first stage, about 45 to 80 psia for the second stage, and about 15 to about 30 psia for the third stage of pressure reduction. More preferred pressure ranges for the three-stage pressure reduction procedure are about 180 to 200 psia, about 50 to 70 psia, and about 20 to about 30 psia.

Nitrogen Removal from Pressurized LNG-Bearing Streams

When appreciable nitrogen exists in the natural gas feed stream, various methodologies are available to those skill in the art to insure that the BTU content of the LNG stream will meet desired specifications. These methodologies require that nitrogen be removed from the LNG-bearing stream and ultimately, removed from the process in some manner. When nitrogen concentration in the processed natural gas feed stream is low, typically less than about 0.5 mol %, nitrogen removal is generally achieved by a side draw at the methane compressor, preferably removing a small stream at the high pressure inlet or outlet port at the open methane cycle compressor. In another embodiment for nitrogen concentration in the processed natural gas feed stream of less than about 0.5 mol %, nitrogen can be removed by subjecting the pressurized LNG-bearing stream from the main methane economizer to a flash step prior to the expansion steps previously discussed. The resulting flash stream will contain an appreciable concentration of nitrogen and may be subsequently employed as a fuel gas. A typical flash pressure for nitrogen removal at these concentrations is about 400 psia. When the processed natural gas feed stream stream contains a nitrogen concentration of greater than about 0.5 mol %, the flash step following flow through the main methane economizer may provide insufficient nitrogen removal and a fractionation or stripping column may be required from which is produced a nitrogen-bearing gas stream and a pressurized LNG-bearing stream. In one preferred methodology employing a nitrogen rejection column the pressurized LNG-bearing stream to the main methane economizer is split into at least a first and second portion. The first portion is flashed to approximately 300 to 500 psia, preferably approximately 400 psia, and the two-phase mixture is fed to the lower section of the stripping column. The second portion of the pressurized LNG-bearing stream is further cooled by flowing through the main methane economizer. This stream is then flashed to approximately 300 to 500 psia, more preferably approximately 400 psia, and the resulting two-phase mixture is fed to the upper section of the stripping column where it functions as a reflux stream. A nitrogen enriched gas stream is then produced from the top of the stripping column. Historically, this stream has been designated a fuel gas stream. Produced from the bottom of the column is a pressurized LNG-bearing stream which is either returned to the main methane economizer for cooling or in the preferred embodiment, is fed to the next stage of expansion in the open methane cycle.

Inventive Nitrogen Removal Methodologies and Apparatus

The nitrogen removal methodologies set forth above are acceptable when the nitrogen enriched gas stream which is also methane bearing can be effectively utilized. However when there is no demand for this stream because of low BTU content or there is no demand for fuel gas or the variability in fuel gas quality is unacceptable because of the effects of process upsets, alternative methodologies for removing nitrogen from an LNG liquefaction process employing an open methane cycle are required. Two inventive embodiments are set forth below.

Embodiment A

In the most preferred embodiment, a process for removing low boiling point inorganic components such as nitrogen from a pressurized gas stream, where such gas stream is formed by the pressure reduction of a pressurized LNG-bearing stream and subsequent separation into said pressurized gas stream and a liquid stream, has been discovered comprising the steps of (a) splitting said pressurized gas stream via a splitting means into a first stream and a second stream, (b) cooling said first stream via an indirect heat exchange means thereby producing a liquid-bearing stream, preferably a totally condensed stream, (c) contacting said liquid-bearing stream and second stream in a countercurrent, multistage manner in a stripper column thereby producing a first gas stream and a liquid stream, (d) splitting via a splitting means said first gas stream into a second gas stream and a third gas stream, (e) cooling via an indirect heat exchange means and reducing the pressure via a pressure reduction means said second gas stream thereby producing a second liquid-bearing stream, preferably a totally condensed stream, (f) reducing the pressure of said third gas stream via a pressure reduction means, (g) contacting said second liquid-bearing stream and reduced pressure third stream in a countercurrent, multistage manner in a stripper column thereby producing a fourth gas stream and a second liquid stream, (h) cooling via an indirect heat exchange means and reducing the pressure via a pressure reduction means said fourth gas stream thereby producing a third liquid-bearing stream, preferably a stream possessing about 0.10 to about 0.30 vapor fraction, more preferably about 0.15 to about 0.25 vapor fraction, (i) reducing the pressure of said second liquid stream via a pressure reduction means thereby producing a vapor-bearing stream which preferably contains about 0.10 to about 0.30 vapor fraction, more preferably about 0.15 to about 0.25 vapor fraction, (j) contacting said third liquid-bearing stream and reduced pressure third liquid stream (i.e., vapor-bearing stream) in a countercurrent, multistage manner in a stripper column thereby producing a fifth gas stream which is a low BTU nitrogen-rich gas stream and a third liquid stream which upon sufficient warming becomes a high BTU methane-rich gas stream, and (k) warming said fifth gas stream and third liquid stream via indirect heat exchange means wherein said streams are employed as cooling agents for steps (e) and (h) and wherein said indirect heat exchange means of this step and indirect heat exchange means of steps (e) and (h) are in thermal contact. Preferably said pressurized LNG-bearing stream is produced via a liquefaction process comprising an open methane cycle refrigeration process and further comprised of the step of (l) combining said warmed third liquid stream of step (k), preferably a gaseous stream (i.e., a processed flash gas stream), with a flash gas stream or warmed flash gas stream on the low pressure side of the first stage of methane compression. More preferably, the process is further comprised of the steps of (m) reducing via a pressure reduction means the pressure of said liquid stream of (c); and (n) warming said stream of (m) via an indirect heat transfer means by employing said stream as a cooling agent for step (b) wherein said indirect heat transfer means of this and the indirect heat transfer means of step (b) are in thermal contact. Still yet more preferably, the process is further comprised of the step of (o) combining said stream of step (n) (i.e., a processed flash gas stream) with a gas stream, preferably a flash gas stream or warmed flash gas stream, on the low pressure side of the second stage of methane compression.

More preferably, the open methane cycle refrigeration process employs three stages of compression. Still more preferably, the liquefaction process comprising an open methane cycle refrigeration process is further comprised of a least two closed cycle refrigeration processes and wherein said refrigeration processes are interconnected in a cascaded manner. It is preferable that one closed cycle employs a refrigerant consisting essentially of propane and the second closed cycle employs a refrigerant selected from the group consisting essentially of ethane, ethylene and mixtures thereof and most preferably consisting essentially of ethylene.

The pressure of the pressurized LNG-bearing stream is preferably greater than about 500 psia, more preferably about 500 to 900 about psia, still more preferably about 500 psia to about 675, still yet more preferably about 600 psia to about 675 psia, and most preferably about 625 psia. The pressure of said streams of step (c) are preferably about 145 psia to about 300 psia, more preferably about 165 psia to about 225 psia, and still more preferably about 185 to about 205 psia and most preferably about 195 psia. The pressures of said streams of step (g) are preferably about 130 psia to about 285 psia, more preferably about 150 psia to about 210 psia, still more preferably about 170 to about 195 psia and most preferably about 180 psia. The pressures of the streams of step (j) are preferably less than 40 psia, more preferably about 20 psia to about 40 psia, and most preferably about 20 psia to about 35 psia. The pressure of the warmed gas stream of step (n) is preferably about 40 psia to about 100 psia, more preferably about 45 to about 80 psia, and most preferably about 70 to about 75 psia. The preferred temperatures of these streams are dependant on pressure and stream composition. Generally, the temperatures of said streams of step (c) are preferably about −140 F to about −210 F, more preferably about −170 F to about −190 F and most preferably about −180 F.

In the preceding methodology, various gas streams are split whereupon one stream may undergo further cooling and/or pressure reduction and the other stream may undergo a pressure reduction. The relative proportion of each of the split streams and the degree of cooling provided to a given stream will be dependant on the composition of the gas stream, the degree of cooling available, and requirements associated with the operation of the downstream stripper column. Such determinations are readily within the skill of one skilled in the art. The number of theoretical plates in the stripping columns of steps (c), (g) and () will be dependant on the composition of the feed streams to the column. The theoretical stages in the stripping column may be provided by trays and/or packing. A packed column is preferred.

It is preferred that the indirect heat exchange means be embodied within plate fin heat exchangers and that the streams undergoing cooling flow generally countercurrent, preferably countercurrent, to the streams which they are in indirect contact with and which function as cooling agents to said streams.

Embodiment B

Another embodiment of the invention concerns removing low boiling point inorganic components such as nitrogen from a pressurized LNG-bearing stream comprises the steps of (a) splitting said stream via a splitting means into a first stream and a second stream, (b) cooling via an indirect heat exchange means and reducing the pressure via a pressure reduction means said first stream thereby producing a liquid-bearing stream, preferably a liquid-phase stream, (c) reducing via a pressure reduction means the pressure of said second stream, (d) contacting said cooled and reduced pressure first stream and reduced pressure second stream in a countercurrent, multistage manner in a stripper column thereby producing a first gas and a liquid stream, (e) splitting via a splitting means said first gas stream into a second gas stream and a third gas stream, (f) cooling via an indirect heat exchange means and reducing the pressure via a pressure reduction means said second gas stream thereby producing a liquid-bearing stream, preferably a totally condensed stream, (g) reducing via a pressure reduction means the pressure of said third gas stream, (h) contacting said liquid-bearing stream and reduced pressure third stream in a countercurrent, multistage manner in a stripper column thereby producing a fourth gas and a second liquid stream, (i) cooling via an indirect heat exchange means and reducing the pressure via a pressure reduction means said fourth gas stream thereby producing a second liquid-bearing stream which preferably contains about 0.10 to about 0.30 vapor fraction, more preferably about 0.15 to about 0.25 vapor fraction, (0) reducing the pressure of said second liquid stream via a pressure reduction means thereby producing a vapor-bearing stream which preferably contains about 0.10 to about 0.30 vapor fraction, more preferably about 0.15 to about 0.25 vapor fraction, (k) contacting said second liquid-bearing stream and reduced pressure third liquid stream in a countercurrent, multistage manner in a stripper column thereby producing a fifth gas stream which is a low BTU nitrogen-rich gas stream and a third liquid stream which upon sufficient warming becomes a high BTU methane-rich gas stream, and (1) warming via indirect heat exchange means said fifth gas stream and third liquid stream wherein said streams are employed as cooling agents for steps (f) and (i) and said heat exchange means are in thermal contact with said heat exchange means of steps (f) and (i). Preferably, the LNG-bearing stream is produced via a liquefaction process comprising an open methane cycle refrigeration process and further comprises the step of (m) combining said warmed third liquid stream of step (l), preferably a gaseous stream (i.e., a processed flash gas stream), with a flash gas stream or warmed flash gas stream on the low pressure side of the first stage of methane compression.

More preferably, the open methane cycle refrigeration process employs three stages of compression. Still more preferably, the liquefaction process comprising an open methane cycle refrigeration process is further comprised of a least two closed cycle refrigeration processes and wherein said refrigeration processes are interconnected in a cascaded manner. It is preferable that one closed cycle employs a refrigerant consisting essentially of propane and the second closed cycle employs a refrigerant selected from the group consisting essentially of ethane, ethylene and mixtures thereof and most preferably consisting essentially of ethylene.

The pressure of the pressurized LNG-bearing stream is preferably greater than about 500 psia, more preferably about 500 to about 900 psia, still more preferably about 500 psia to about 675, still yet more preferably about 600 psia to about 675 psia, and most preferably about 625 psia. The pressures of said streams of step (d) are preferably about 300 psia to about 550 psia, more preferably 325 psia to 450 psia, and most preferably about 325 psia to about 400, and still most preferably about 350 psia. The pressures of said streams of steps (h) are preferably about 100 to about 300 psia, more preferably about 150 to about 250 psia, and most preferably about 200 psia. The pressures of the streams of step (k) are preferably less than 40 psia, more preferably about 20 to about 40 psia, and most preferably about 20 to about 35 psia. The preferred temperatures of the preceding streams are dependant on pressure and stream composition. Generally, the temperatures of the streams of step (d) are preferably about −140 F to about −200 F, more preferably about −160 F to about −180 F and most preferably about −170 F.

In the preceding methodology, various gas streams are split whereupon one stream may undergo further cooling and/or pressure reduction and the other stream may undergo a pressure reduction. The relative proportion of each of the split streams and the degree of cooling provided to a given stream will be dependant on the composition of the gas stream, the degree of cooling available, and requirements associated with the operation of the downstream stripper column. Such determinations are readily within the skill of one skilled in the art. The number of theoretical plates in the stripping columns of steps (c), (g) and (j) will be dependant on the composition of the feed streams to the column. The theoretical stages in the stripping column may be provided by trays and/or packing. A packed column is preferred.

It is preferred that the indirect heat exchange means be embodied within plate fin heat exchangers. It is preferred that the streams undergoing cooling flow generally countercurrent, preferably countercurrent, to the streams which they are in indirect contact with and which function as cooling agents to said streams.

In the preceding two embodiments, reference is made to a pressure reduction means. Although such means may be a distinct element such as a Joule Thompson valve, a gas expander or a hydraulic expander, such means also includes a simple orifice or a reduction in pressure associated with a greater cross-sectional area to flow (ex. introduction of a stream via a pipe into a large tank).

Preferred Embodiments of Open Cycle Cascaded Liquefaction Process

Figure 2:
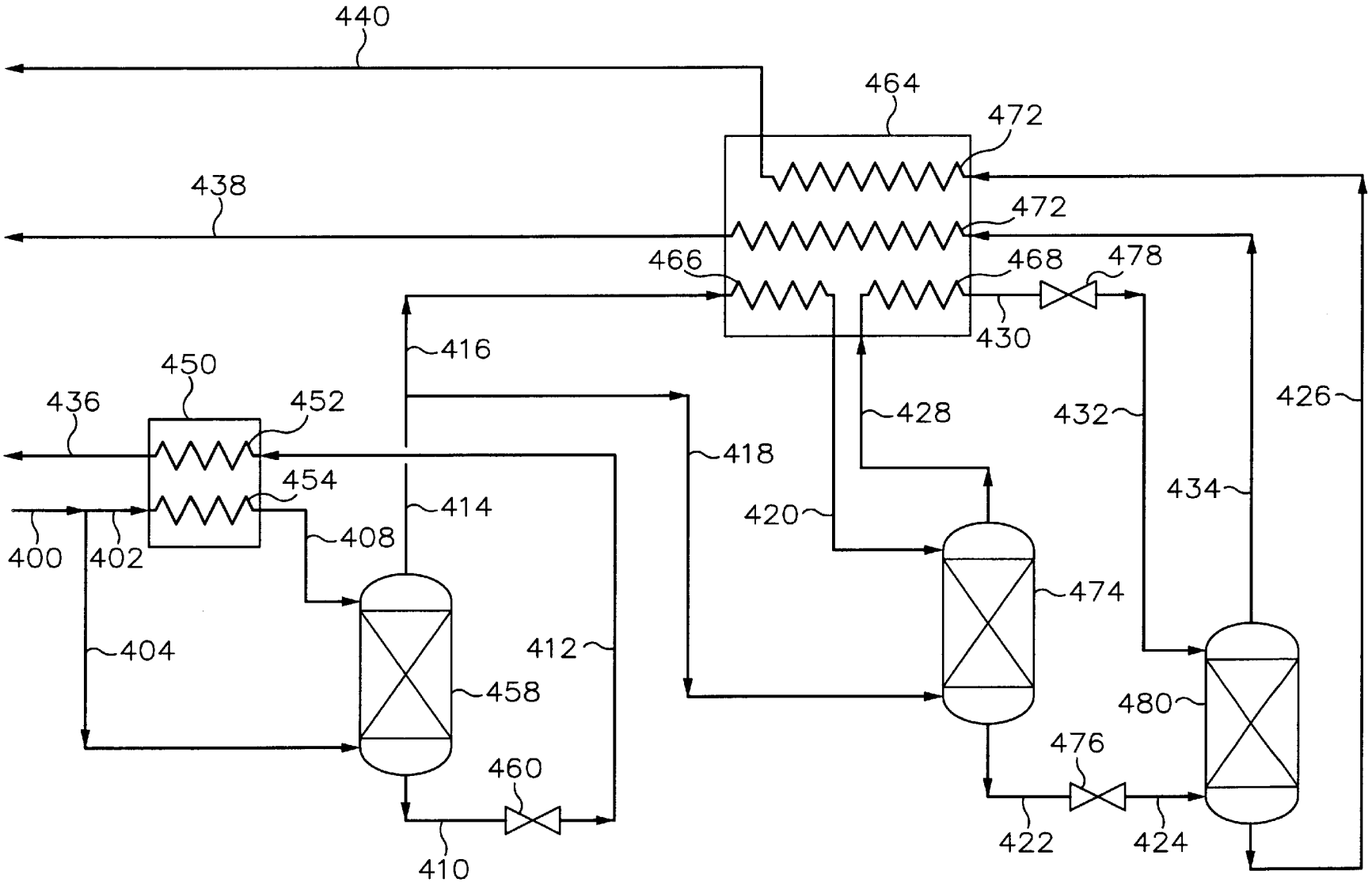
FIGS. 2 and 3 are simplified diagrams which illustrate preferred embodiments of the methodologies and associated apparatus for removing nitrogen and/or other low boiling point inorganic components such as helium from pressurized LNG-bearing streams or streams produced therefrom.
Figure 3:
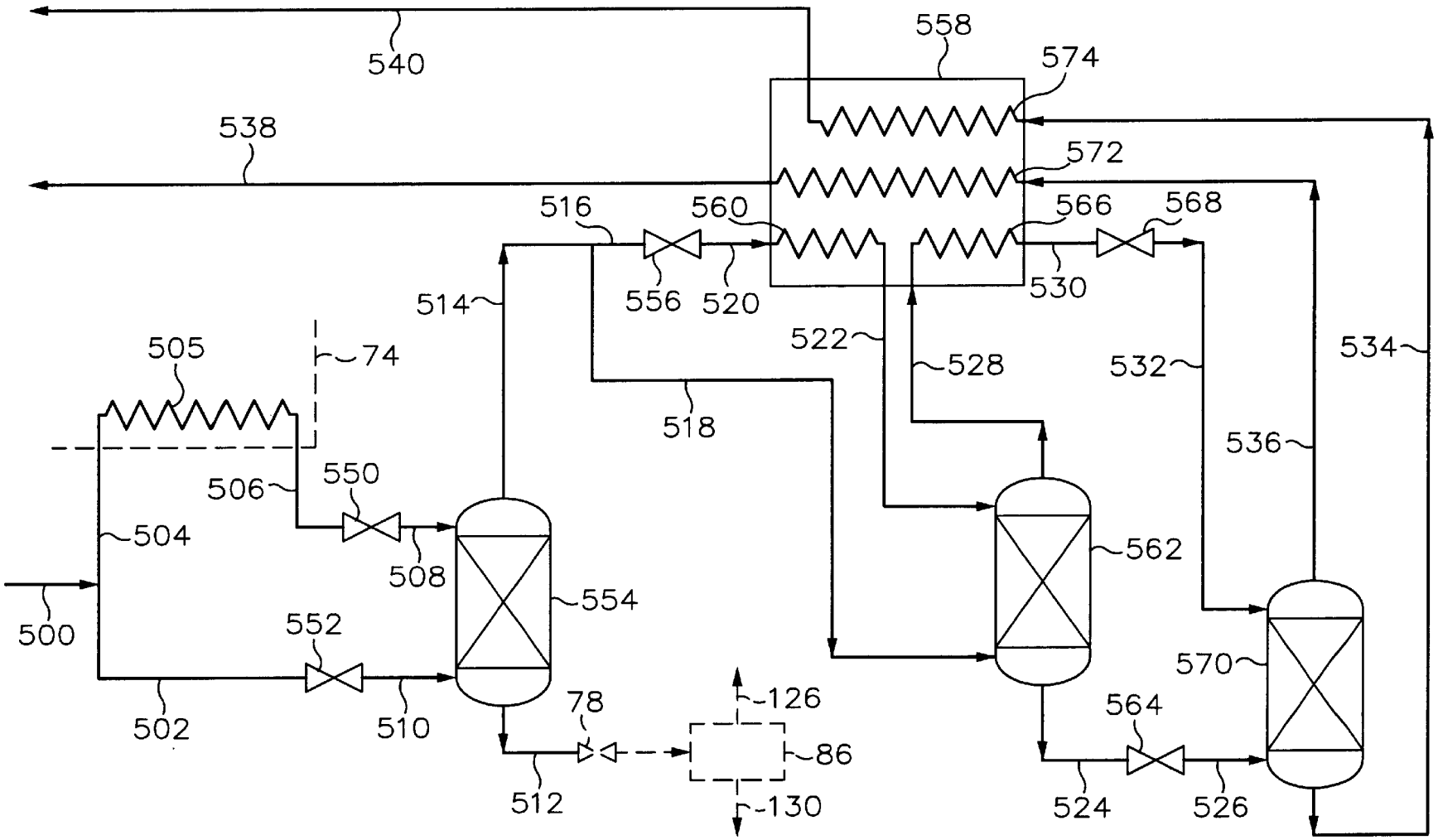

The flow schematic and apparatus set forth in FIG. 1 is a preferred embodiment of the open-cycle cascaded liquefaction process and is set forth for illustrative purposes. Purposely omitted from this embodiment is a nitrogen removal system because such system is dependant on the nitrogen content of the feed gas and fuel gas requirements. FIGS. 2 and 3 generally depict the respective nitrogen removal methodologies of Embodiments A and B of the current invention. The ensuing discussion will address the integration of the process methodologies and associated apparatus depicted in FIGS. 2 and 3 into the process methodology and apparatus depicted in FIG. 1. Those skilled in the art will recognized that FIGS. 1, 2 and 3 are schematics only and therefore, many items of equipment that would be needed in a commercial plant for successful operation have been omitted for the sake of clarity. Such items might include, for example, compressor controls, flow and level measurements and corresponding controllers, temperature and pressure controls, pumps, motors, filters, additional heat exchangers, and valves, etc. These items would be provided in accordance with standard engineering practice.

To facilitate an understanding of FIGS. 1, 2 and 3, the following numbering nomenclature was employed. Items numbered 1 thru 99 are process vessels and equipment depicted in FIG. 1 which are directly associated with the liquefaction process excluding items directly associated with nitrogen removal. Items numbered 100 thru 199 correspond to flow lines or conduits depicted in FIG. 1 which contain methane in major portion. Items numbered 200 thru 299 correspond to flow lines or conduits depicted in FIG. 1 which contain the refrigerant ethylene. Items numbered 300–399 correspond to flow lines or conduits depicted in FIG. 1 which contain the refrigerant propane. Items number 400–499 correspond to process vessels, equipment, and flow lines or conduits depicted in FIG. 2. Items number 500–599 correspond to process vessels, equipment, and flow lines or conduits depicted in FIG. 3.

A natural gas feed stream, as previously described, is introduced to the system through conduit 100. Gaseous propane is compressed in multistage compressor 18 driven by a gas turbine driver which is not illustrated. The three stages preferably form a single unit although they may be separate units mechanically coupled together to be driven by a single driver. Upon compression, the compressed propane is passed through conduit 300 to cooler 20 where it is liquefied. A representative pressure and temperature of the liquefied propane refrigerant prior to flashing is about 100° F. and about 190 psia. Although not illustrated in FIG. 1, it is preferable that a separation vessel be located downstream of cooler 20 and upstream of expansion valve 12 for the removal of residual light components from the liquefied propane. Such vessels may be comprised of a single-stage gas liquid separator or may be more sophisticated and comprised of an accumulator section, a condenser section and an absorber section, the latter two of which may be continuously operated or periodically brought on-line for removing residual light components from the propane. The stream from this vessel or the stream from cooler 20, as the case may be, is pass through conduit 302 to a pressure reduction means such as a expansion valve 12 wherein the pressure of the liquefied propane is reduced thereby evaporating or flashing a portion thereof. The resulting two-phase product then flows through conduit 304 into high-stage propane chiller 2 wherein indirect heat exchange with gaseous methane refrigerant introduced via conduit 152, natural gas feed introduced via conduit 100 and gaseous ethylene refrigerant introduced via conduit 202 are respectively cooled via indirect heat exchange means 4, 6 and 8 thereby producing cooled gas streams respectively produced via conduits 154, 102 and 204.

The flashed propane gas from chiller 2 is returned to compressor 18 through conduit 306. This gas is fed to the high stage inlet port of compressor 18. The remaining liquid propane is passed through conduit 308, the pressure further reduced by passage through a pressure reduction means, illustrated as expansion valve 14, whereupon an additional portion of the liquefied propane is flashed. The resulting two-phase stream is then fed to chiller 22 through conduit 310 thereby providing a coolant for chiller 22.

The cooled natural gas feed stream from chiller 2 flows via conduit 102 to a knock-out vessel 10 wherein gas and liquid phases are separated. The liquid phase which is rich in C3+ components is removed via conduit 103. The gaseous phase is removed via conduit 104 and conveyed to propane chiller 22. Ethylene refrigerant is introduced to chiller 22 via conduit 204. In the chiller, the processed natural gas stream and an ethylene refrigerant stream are respectively cooled via indirect heat exchange means 24 and 26 thereby producing a cooled processed natural gas stream and an ethylene refrigerant stream via conduits 110 and 206. The thus evaporated portion of the propane refrigerant is separated and passed through conduit 311 to the intermediate-stage inlet of compressor 18. Liquid propane is passed through conduit 312, the pressure further reduced by passage through a pressure reduction means, illustrated as expansion valve 16, whereupon an additional portion of liquefied propane is flashed. The resulting two-phase stream is then fed to chiller 28 through conduit 314 thereby providing coolant to chiller 28.

As illustrated in FIG. 1, the cooled processed natural gas stream flows from the intermediate-stage propane chiller 22 to the low-stage propane chiller/condenser 28 via conduit 110. In this chiller, the stream is cooled via indirect heat exchange means 30. In a like manner, the ethylene refrigerant stream flows from the intermediate-stage propane chiller 22 to the low-stage propane chiller/condenser 28 via conduit 206. In the latter, the ethylene-refrigerant is condensed via an indirect heat exchange means 32 in nearly its entirety. The vaporized propane is removed from the low-stage propane chiller/condenser 28 and returned to the low-stage inlet at the compressor 18 via conduit 320. Although FIG. 1 illustrates cooling of streams provided by conduits 110 and 206 to occur in the same vessel, the chilling of stream 110 and the cooling and condensing of stream 206 may respectively take place in separate process vessels (ex., a separate chiller and a separate condenser, respectively).

As illustrated in FIG. 1 and in accordance with the invention herein disclosed and claimed, a portion of the cooled compressed open methane cycle gas stream is provided via conduit 156, combined with the processed natural gas feed stream exiting the low-stage propane chiller via conduit 112 thereby forming a liquefaction stream and this stream is then introduced to the high-stage ethylene chiller 42 via conduit 114. Ethylene refrigerant exits the low-stage propane chiller 28 via conduit 208 and is fed to a separation vessel 37 wherein light components are removed via conduit 209 and condensed ethylene is removed via conduit 210. The separation vessel is analogous to the earlier discussed for the removal of light components from liquefied propane refrigerant and may be a single-stage gas/liquid separator or may be a multiple stage operation resulting in a greater selectivity of the light components removed from the system. The ethylene refrigerant at this location in the process is generally at a temperature of about −24° F. and a pressure of about 285 psia. The ethylene refrigerant via conduit 210 then flows to the main ethylene economizer 34 wherein it is cooled via indirect heat exchange means 38 and removed via conduit 211 and passed to a pressure reduction means such as an expansion valve 40 whereupon the refrigerant is flashed to a preselected temperature and pressure and fed to the high-stage ethylene chiller 42 via conduit 212. Vapor is removed from this chiller via conduit 214 and routed to the main ethylene economizer 34 wherein the vapor functions as a coolant via indirect heat exchange means 46. The ethylene vapor is then removed from the ethylene economizer via conduit 216 and feed to the high-stage inlet on the ethylene compressor 48. The ethylene refrigerant which is not vaporized in the high-stage ethylene chiller 42 is removed via conduit 218 and returned to the ethylene main economizer 34 for further cooling via indirect heat exchange means 50, removed from the main ethylene economizer via conduit 220 and flashed in a pressure reduction means illustrated as expansion valve 52 whereupon the resulting two-phase product is introduced into the low-stage ethylene chiller 54 via conduit 222. The liquefaction stream is removed from the high-stage ethylene chiller 42 via conduit 116 and directly fed to the low-stage ethylene chiller 54 wherein it undergoes additional cooling and partial condensation via indirect heat exchange means 56. The resulting two-phase stream then flows via conduit 118 to a two phase separator 60 from which is produced a methane-rich vapor stream via conduit 119 and via conduit 117, a liquid stream rich in $C_2$+ components which is subsequently flashed or fractionated in vessel 67 thereby producing via conduit 123 a heavies stream and a second methane-rich stream which is transferred via conduit 121 and after combination with a second stream via conduit 128 is fed to the high pressure inlet port on the methane compressor 83.

The stream in conduit 119 and a cooled compressed open methane cycle gas stream provided via conduit 158 are combined and fed via conduit 120 to the low-stage ethylene condenser 68 wherein this stream exchanger heat via indirect heat exchange means 70 with the liquid effluent from the low-stage ethylene chiller 54 which is routed to the low-stage ethylene condenser 68 via conduit 226. In condenser 68, the combined streams are condensed and produced from condenser 68 via conduit 122 is a pressurized LNG-bearing stream. The vapor from the low-stage ethylene chiller 54 via conduit 224 and low-stage ethylene condenser 68 via conduit 228 are combined and routed via conduit 230 to the main ethylene economizer 34 wherein the vapors function as a coolant via indirect heat exchange means 58. The stream is then routed via conduit 232 from the main ethylene economizer 34 to the low-stage side of the ethylene compressor 48. As noted in FIG. 1, the compressor effluent from vapor introduced via the low-stage side is removed via conduit 234, cooled via inter-stage cooler 71 and returned to compressor 48 via conduit 236 for injection with the high-stage stream present in conduit 216. Preferably, the two-stages are a single module although they may each be a separate module and the modules mechanically coupled to a common driver. The compressed ethylene product from the compressor is routed to a downstream cooler 72 via conduit 200. The product from the cooler flows via conduit 202 and is introduced, as previously discussed, to the high-stage propane chiller 2.

The pressurized LNG-bearing stream, preferably a liquid stream in its entirety, in conduit 122 is generally at a temperature of about −125° F. and about 615 psia. This stream passes via conduit 122 through the main methane economizer 74 wherein the stream is further cooled by indirect heat exchange means 76 as hereinafter explained. From the main methane economizer 74 the pressurized LNG-bearing stream passes through conduit 124 and its pressure is reduced by a pressure reductions means which is illustrated as expansion valve 78, which of course evaporates or flashes a portion of the gas stream thereby generating a flash gas stream. The flashed stream is then passed to methane high-stage flash drum 80 where it is separated into a flash gas stream discharged through conduit 126 and a liquid phase stream (i.e., pressurized LNG-bearing stream) discharged through conduit 130. The flash gas stream is then transferred to the main methane economizer via conduit 126 wherein the stream functions as a coolant via indirect heat exchange means 82. The flash gas stream (i.e., warmed flash gas stream) exits the main methane economizer via conduit 128 where it is combined with a gas stream delivered by conduit 121. These streams are then fed to the low pressure side of the high pressure stage of compressor 83. The liquid phase in conduit 130 is passed through a second methane economizer 87 wherein the liquid is further cooled via indirect heat exchange means 88 by a downstream flash gas stream. The cooled liquid exits the second methane economizer 87 via conduit 132 and is expanded or flashed via pressure reduction means illustrated as expansion valve 91 to further reduce the pressure and at the same time, evaporate a second portion thereof. This flash gas stream is then passed to intermediate-stage methane flash drum 92 where the stream is separated into a flash gas stream passing through conduit 136 and a liquid phase stream passing through conduit 134. The flash gas stream flows through conduit 136 to the second methane economizer 87 wherein the gas cools the liquid introduced to 87 via conduit 130 via indirect heat exchanger means 89. Conduit 138 serves as a flow conduit between indirect heat exchange means 89 in the second methane economizer 87 and the indirect heat exchange means 95 in the main methane economizer 74. The warmed flash gas stream leaves the main methane economizer 74 via conduit 140 which is connected to the inlet to the low pressure side of the intermediate stage of methane compressor 83. The liquid phase exiting the intermediate stage flash drum 92 via conduit 134 is further reduced in pressure, preferably to about 25 psia, by passage through a pressure reduction means illustrated as a expansion valve 93. Again, a third portion of the liquefied gas is evaporated or flashed. The fluids from the expansion valve 93 are passed to final or low stage flash drum 94. In flash drum 94, a vapor phase is separated as a flash gas stream and passed through conduit 144 to the second methane economizer 87 wherein the flash gas stream functions as a coolant via indirect heat exchange means 90, exits the second methane economizer via conduit 146 which is connected to the first methane economizer 74 wherein the flash gas stream functions as a coolant via indirect heat exchange means 96 and ultimately leaves the first methane economizer via conduit 148 which is connected to the low side of the low pressure stage of compressor 83. The liquefied natural gas product (i.e., the LNG stream) from flash drum 94 which is at approximately atmospheric pressure is passed through conduit 142 to the storage unit. The low pressure, low temperature LNG boil-off vapor stream from the storage unit is preferably recovered by combining such stream with the low pressure flash gases present in either conduits 144, 146, or 148; the selected conduit being based on a desire to match gas stream temperatures as closely as possible.

As shown in FIG. 1, the high, intermediate and low stages of compressor 83 are preferably combined as single unit. However, each stage may exist as a separate unit where the units are mechanically coupled together to be driven by a single driver. The compressed gas from the low-stage section passes through an inter-stage cooler 85 and is combined with the intermediate pressure gas in conduit 140 prior to the second-stage of compression. The compressed gas from the intermediate stage of compressor 83 is passed through an inter-stage cooler 84 and is combined with the high pressure gas provided via conduits 121 and 128 prior to the third-stage of compression. The compressed gas (i.e., compressed open methane cycle gas stream) is discharged from high stage methane compressor through conduit 150, is cooled in cooler 86 and is routed to the high pressure propane chiller 2 via conduit 152 as previously discussed. The stream is cooled in chiller 2 via indirect heat exchange means 4 and flows to the main methane economizer via conduit 154. As used herein and previously noted, compressor also refers to each stage of compression and any equipment associated with interstage cooling.

As illustrated in FIG. 1, the compressed open methane cycle gas stream from chiller 2 which enters the main methane economizer 74 undergoes cooling in its entirety via flow through indirect heat exchange means 97. A portion of this cooled stream is then removed via conduit 156 and combined with the processed natural gas feed stream upstream of the first stage (i.e., high pressure) of ethylene cooling. The remaining portion of this cooled stream undergoes further cooling via indirect heat transfer mean 98 in the main methane economizer and is produced therefrom via conduit 158. This stream is combined with the above cited combined stream at a location upstream of the final stage (i.e., low pressure) of ethylene cooling and this liquifaction stream then undergoes liquefaction in major portion in the ethylene condenser 68 via flow through indirect heat exchange means 70.

With regard to the preferred inventive embodiment depicted in FIG. 2 and the integration of this methodology and apparatus into the methodology and apparatus depicted in FIG. 1, the flash gas stream produced via conduit 126 is split via a splitting means into a pressurized gas stream which is produced via conduit 400 and the remaining portion routed to indirect heat exchange mean 82 in main methane economizer 74. The pressurized gas stream is routed to a splitting means from which is produced a first stream via conduit 402 and a second stream via conduit 404 which is connected to the lower section of a stripper column to be discussed. The first stream is cooled via indirect heat exchange means 454 thereby producing via conduit 408 a liquid-bearing stream which is introduced into the upper section of stripper column 458. The liquid-bearing stream and second stream are contacted in a countercurrent, multistage manner in stripper column 458 thereby producing a first gas stream via conduit 414 and a liquid stream via conduit 410. The first gas stream is routed via conduit 414 to a splitting means whereat said first gas stream is split into a second gas stream which is produced via conduit 416 and third gas stream produced via conduit 418. The second gas stream is routed via conduit 416 to indirect heat exchange means 466 where such stream is cooled thereby producing a second liquid-bearing stream which is produced via conduit 420 which is connected to the upper section of stripper column 474 whereat said stream is contacted in a countercurrent, multistage manner with the third gas stream routed to the lower section of the stripper column via conduit 418 and from which is produced a fourth gas via conduit 428 and a second liquid stream via conduit 422. The third gas stream is routed to an indirect heat exchange means 468 where said stream is cooled and produced via conduit 430 which is connected to pressure reduction means 468 whereat said pressure is reduced thereby producing via conduit 432 a third liquid-bearing stream. This conduit is connected to the upper section of stripper column 480. The second liquid produced via conduit 422 is routed to pressure reduction means 476 thereby producing a fourth stream which is routed to the lower section of stripper column 480 via conduit 424. This stream and the third liquid-bearing stream are contacted in stripper column 480 in a countercurrent, multistage manner thereby producing a fifth gas stream via conduit 434 and a third liquid stream via conduit 426. Such conduits are respectively connected to indirect heat exchange means 470 and 472 which are in thermal contact with heat exchange means 466 and 468 in economizer 464 thereby producing via conduit 438 and 440 a low BTU nitrogen-rich gas stream and a high BTU methane-rich gas stream. Conduit 440 is preferably connected to conduit 146 thereby returning said stream to the low pressure side of the first stage of methane compression in the open methane cycle. Conduit 438 is preferably connected to an indirect heat exchange mean in main methane economizer 74 wherein said stream functions as a cooling agent. The liquid stream in conduit 410 is preferably routed to pressure reduction means 460 whereupon a reduced pressure stream is produced which is routed via conduit 412 to an indirect heat exchange mean 452 in economizer 450 where said heat exchange means is in thermal contact with indirect heat exchange means 454 thereby producing a warmed stream produced via conduit 436. Conduit 436 is preferably connected to either conduit 136 or conduit 138, preferably to conduit 138 because of the proximity of the stream temperatures to one another, thereby providing a means of returning such stream to the low pressure side of the second stage of methane compression in the open methane cycle.

With regard to the inventive embodiment depicted in FIG. 3 for nitrogen removal, the pressurized LNG-bearing stream in conduit 500 is obtained by connecting said conduit to conduit 122 of FIG. 1 or preferably connecting said conduit to a splitting means in flow communication with conduit 122. In either methodology, it is preferred that the indirect heat exchange means 76 depicted in FIG. 1 be eliminated and in the preferred methodology that the splitting means be connected via conduit to pressure reduction means 78. Conduit 500 is also connected to a splitting means which is connected conduits 504 and 502. A first stream and a second stream are respectively produced from conduits 504 and 502. Conduit 504 is connected to indirect heat exchange means 505 which is situated in the main methane economizer and which provides a means for cooling said first stream which is produced via conduit 506. The pressure of the stream produced via conduit 506 is reduced via pressure reduction means 550 and the resulting liquid-bearing stream is introduced to the upper section of a stripper column 554 via conduit 502. The second stream in conduit 502 is routed to pressure reduction means 552 which is connected to conduit 510 and from which is produced a reduced pressure second stream. Conduit 510 is connected to the lower section of stripper column 554 wherein said liquid-bearing stream and reduced pressure second stream are contacted in a countercurrent, multistage manner thereby producing a first gas via conduit 514 and a liquid stream via conduit 512. The liquid stream in conduit 512 may be separately flashed to lower pressures in the manner depicted in FIG. 1 or in the preferred methodology where the stream in conduit 122 is split into two streams, the liquid stream in conduit 512 or a liquid stream produced therefrom is combined with the split stream from conduit 122 or a stream produced therefrom at an appropriate downstream location (i.e., preferably similar temperatures and pressures).

The first gas stream produced via conduit 514 is routed to a splitting means from which is produced a second gas stream via conduit 516 and a third gas stream via conduit 518. Conduit 516 is connected to pressure reduction means 556 which is connected to conduit 520 which is in turn connected to indirect heat exchange means 560 thereby producing a liquid-bearing gas stream via conduit 522 which is connected to the upper section of stripper column 562. The third gas stream is routed via conduit 518 to stripper column 562. Although a pressure reduction means is not illustrated in FIG. 3 in regard to the third gas stream, the stream does undergo pressure reduction upon entering the lower section of stripper column 562. In stripper column 562, the streams delivered via conduits 522 and 518 are contacted in a countercurrent, multistage manner thereby producing a fourth gas and a second liquid stream which are respectively produced via conduits 528 and 524. Said fourth gas stream is routed via conduit 528 to indirect heat exchange means 566 and produced via conduit 530 which is connected to pressure reduction means 568 thereby producing via conduit 532 which is connected to the upper section of stripper column 570 a second liquid-bearing stream. The second liquid stream is routed via conduit 524 to pressure reduction means 564 which is connected to conduit 526 from which is produced a reduced pressure second liquid stream. Conduit 526 is connected to the lower section of stripper column 570. In stripper column 570, the streams delivered via conduits 526 and 532 are contacted in a countercurrent, multistage manner thereby producing a fifth gas stream and a third liquid stream which are respectively produced via conduits 536 and 534. Conduits 534 and 536 are respectively connected to indirect heat exchange means 574 and 572 which are in thermal contact with indirect heat exchangers 560 and 566 where such exchangers are situated in economizer 558. Said fifth gas stream and third liquid stream are warmed upon flowing through indirect heat exchange means 572 and 574 thereby producing a low BTU nitrogen-rich gas stream via conduit 538 and a high BTU methane-rich gas stream via conduit 540. Conduit 540 is connected to conduit 138 thereby providing a means of returning such stream to the low pressure side of the second stage of methane compression on the open methane cycle. Conduit 538 may be routed to main economizer 74 wherein said stream can function as a coolant via an indirect heat exchange means.

As used herein, reference to separate indirect heat exchange means for the cooling or heating of a given stream may physically refer to a single piece of heat transfer equipment wherein is contained two or more indirect heat exchange means. As an example, indirect heat exchange means A and B may refer to a single plate fine heat exchanger wherein the two streams fed to each means undergo heat exchange therein with one another.

FIGS. 1, 2 and 3 depict the expansion of the liquefied phase using expansion valves with subsequent separation of gas and liquid portions in the chiller or condenser. While this simplified scheme is workable and utilized in some cases, it is often more efficient and effective to carry out partial evaporation and separation steps in separate equipment, for example, an expansion valve and separate flash drum might be employed prior to the flow of either the separated vapor or liquid to a propane chiller. In a like manner, certain process streams undergoing expansion are ideal candidates for employment of a hydraulic expander as part of the pressure reduction means thereby enabling the extraction of work and also lower two-phase temperatures.

With regard to the compressor/driver units employed in the process, FIG. 1 depicts individual compressor/driver units (i.e., a single compression train) for the propane, ethylene and open methane cycle compression stages. However in a preferred embodiment for any cascaded process, process reliability can be improved significantly by employing a multiple compression train comprising two or more compressor/driver combinations in parallel in lieu of the depicted single compressor/driver units. In the event that a compressor/driver unit becomes unavailable, the process can still be operated at a reduced capacity. In addition by shifting loads among the compressor/driver units in the manner herein disclosed, the LNG production rate can be further increased when a compressor/driver unit goes down or must operate at reduced capacity.

While specific cryogenic methods, materials, items of equipment and control instruments are referred to herein, it is to be understood that such specific recitals are not to be considered limiting but are included by way of illustration and to set forth the best mode in accordance with the presence invention.

EXAMPLE I

This Example demonstrates the ability of Embodiment A to remove nitrogen from the open methane cycle in a cascaded refrigeration process for LNG production. The simulation demonstrates that the inventive embodiment generally depicted in FIG. 2 is capable of removing nitrogen from a cryogenic gas stream where such stream is obtained by flashing a pressurized LNG-bearing stream and subsequently separating said flash gas stream into gas and liquid streams and in the course of processing said gas stream, produce a low BTU nitrogen-rich gas stream and two high BTU methane-rich gas streams which are suitable for recycle to the open methane cycle or may be employed as a fuel gas. The simulation results were obtained using Hyprotech's Process Simulation HYSIM, Version C2.54, Prop. Pkg PR/LK.

The simulation package was generally configured in the manner set forth in FIG. 1 and more particularly in the manner set forth in FIG. 2. Deviations between the process as illustrated in FIGS. 1 and 2 and that simulated for this Example do not significantly affect the inventive aspects of the process and associated apparatus herein demonstrated. TABLE 1 sets forth

TABLE 1

Stream conditions for embodiment set forth in FIG. 2.

| Stream Number | Vapor Fraction | Temperature (° F.) | Pressure (psia) | Flowrate (lb mole/hr) | Mole % $N_2$ | $CO_2$ | $C_1$ | $C_2$ | $C_3$ | $C_4$ | $C_5$ |
|---|---|---|---|---|---|---|---|---|---|---|---|
| 122 | 0.00 | −127.0 | 615.0 | 100563. | 5.75 | 0.01 | 87.35 | 6.50 | 0.30 | 0.08 | 0.02 |
| 125 | 0.27 | −178.9 | 210.0 | 100563. | 5.75 | 0.01 | 87.35 | 6.50 | 0.30 | 0.08 | 0.02 |
| 126 | 1.00 | −178.9 | 210.0 | 27158. | 14.68 | 0.00 | 85.03 | 0.29 | 0.00 | 0.00 | 0.00 |
| 130 | 0.00 | −178.9 | 210.0 | 73404. | 2.45 | 0.01 | 88.21 | 8.79 | 0.41 | 0.10 | 0.03 |
| 400 | 1.00 | −178.9 | 210.0 | 2800. | 14.68 | 0.00 | 85.03 | 0.29 | 0.00 | 0.00 | 0.00 |
| 402 | 1.00 | −178.9 | 210.0 | 1680. | 14.68 | 0.00 | 85.03 | 0.29 | 0.00 | 0.00 | 0.00 |
| 404 | 1.00 | −178.9 | 210.0 | 1120. | 14.68 | 0.00 | 85.03 | 0.29 | 0.00 | 0.00 | 0.00 |
| 408 | 0.00 | −215.0 | 206.0 | 1680. | 14.68 | 0.00 | 85.03 | 0.29 | 0.00 | 0.00 | 0.00 |
| 410 | 0.00 | −185.9 | 198.0 | 1778. | 2.78 | 0.00 | 96.77 | 0.45 | 0.00 | 0.00 | 0.00 |
| 412 | 0.16 | −219.0 | 75.0 | 1778. | 2.78 | 0.00 | 96.77 | 0.45 | 0.00 | 0.00 | 0.00 |
| 414 | 1.00 | −198.1 | 195.0 | 1022. | 35.40 | 0.00 | 64.59 | 0.01 | 0.00 | 0.00 | 0.00 |
| 416 | 1.00 | −198.1 | 195.0 | 756. | 35.40 | 0.00 | 64.59 | 0.01 | 0.00 | 0.00 | 0.00 |
| 418 | 0.00 | −270.0 | 191.0 | 756. | 35.40 | 0.00 | 64.59 | 0.01 | 0.00 | 0.00 | 0.00 |
| 420 | 1.00 | −199.9 | 185.0 | 266. | 35.40 | 0.00 | 64.59 | 0.01 | 0.00 | 0.00 | 0.00 |
| 422 | 0.00 | −229.0 | 183.0 | 840. | 24.25 | 0.00 | 75.71 | 0.01 | 0.00 | 0.00 | 0.00 |
| 424 | 0.21 | −263.2 | 45.0 | 840. | 24.25 | 0.00 | 75.71 | 0.01 | 0.00 | 0.00 | 0.00 |
| 426 | 0.00 | −272.5 | 31.0 | 732. | 10.19 | 0.00 | 89.80 | 0.01 | 0.00 | 0.00 | 0.00 |
| 428 | 1.00 | −245.5 | 180.0 | 182. | 87.03 | 0.00 | 12.97 | 0.00 | 0.00 | 0.00 | 0.00 |
| 430 | 0.00 | −273.0 | 176.0 | 182. | 87.03 | 0.00 | 12.97 | 0.00 | 0.00 | 0.00 | 0.00 |
| 432 | 0.21 | −307.0 | 28.0 | 182. | 87.03 | 0.00 | 12.97 | 0.00 | 0.00 | 0.00 | 0.00 |
| 434 | 1.00 | −307.0 | 28.0 | 290. | 99.00 | 0.00 | 1.00 | 0.00 | 0.00 | 0.00 | 0.00 |
| 436 | 1.00 | −197.8 | 72.0 | 1778. | 2.78 | 0.00 | 96.77 | 0.00 | 0.00 | 0.00 | 0.00 |
| 438 | 1.00 | −210.0 | 25.0 | 290. | 99.00 | 0.00 | 1.00 | 0.00 | 0.00 | 0.00 | 0.00 |
| 440 | 1.00 | −239.0 | 28.0 | 732. | 10.19 | 0.00 | 89.97 | 0.00 | 0.00 | 0.00 | 0.00 |

the vapor fraction, temperature, pressure, flowrate and composition of the process streams flowing within identified conduits in FIG. 1 and 2. Stream Number corresponds to the flow within the conduit possessing the same number.

Particular emphasis is placed on the properties of the gas stream fed to the process depicted in FIG. 2 (Stream 400), the high BTU methane-rich gas streams produced by the process (Streams 436 and 440), and the low BTU nitrogen-rich gas stream produced by the process (Stream 438). The respective methane concentrations of the four above-cited streams are respectively 87.35, 96.77, 89.97, and 1.0 mole %. The respective nitrogen concentrations of these streams are 14.68, 2.78, 10.19 and 99.00 mole %.

This example clearly illustrates the ability of the process to remove nitrogen from the open methane cycle, to produce a low BTU nitrogen-rich gas stream, and to produce high BTU methane-rich gas streams; streams which may be recycle to the liquefaction process or employed as high quality fuel gas.

EXAMPLE II

This Example demonstrates the ability of Embodiment B to remove nitrogen from the open methane cycle in a cascaded refrigeration process for LNG production. The simulation demonstrates that the inventive embodiment generally depicted in FIG. 3 is capable of removing nitrogen from a pressurized LNG-bearing stream and in so doing, produce an LNG-bearing stream, a low BTU nitrogen-rich gas stream, and a high BTU methane-rich gas stream which is suitable for recycle in the open methane cycle or may be employed as a high BTU-content fuel gas. The simulation results were obtained using Hyprotech's Process Simulation HYSIM, Version C2.54, Prop. Pkg PRILK.

The simulation package was generally configured as set forth in FIG. 1 and more particularly in the manner set forth in FIG. 3. Deviations between the process as illustrated in FIGS. 1 and 3 and that simulated for this Example do not significantly affect the inventive aspects of the process and associated apparatus herein demonstrated. TABLE 2 sets forth the vapor fraction, temperature, pressure, flowrate and composition of the process streams flowing within the conduits numbered in FIG. 3. The Stream Number corresponds to the stream flow with the conduit possessing the same number.

Particular emphasis is placed on the pressurized LNG-bearing stream fed to the process depicted in FIG. 3 (Stream 500), the high BTU methane-rich gas stream produced by the process (Stream 540), and the low BTU nitrogen-rich gas stream produced by the process (Stream 53 8). The

TABLE 2

Stream conditions for embodiment set forth in FIG. 3.

| Stream Number | Vapor Fraction | Temperature (° F.) | Pressure (psia) | Flowrate (lb mole/hr) | Mole % $N_2$ | $CO_2$ | $C_1$ | $C_2$ | $C_3$ | $C_4$ | $C_5$ |
|---|---|---|---|---|---|---|---|---|---|---|---|
| 500 | 0.000 | −131.5 | 615.0 | 39316.0 | 8.26 | 0.01 | 84.80 | 6.53 | 0.30 | 0.08 | 0.01 |
| 502 | 0.000 | −131.5 | 615.0 | 13475.2 | 8.26 | 0.01 | 84.80 | 6.53 | 0.30 | 0.08 | 0.01 |
| 504 | 0.000 | −131.5 | 615.0 | 25840.8 | 8.26 | 0.01 | 84.80 | 6.53 | 0.30 | 0.08 | 0.01 |
| 506 | 0.000 | −182.4 | 609.0 | 25840.8 | 8.26 | 0.01 | 84.80 | 6.53 | 0.30 | 0.08 | 0.01 |
| 508 | 0.000 | −172.5 | 350.0 | 904.9 | 36.16 | 0.00 | 63.57 | 0.27 | 0.00 | 0.00 | 0.00 |
| 512 | 0.000 | −160.7 | 353.0 | 38411.1 | 7.60 | 0.00 | 85.30 | 6.68 | 0.31 | 0.08 | 0.01 |
| 514 | 1.000 | −172.5 | 350.0 | 904.9 | 36.16 | 0.00 | 63.57 | 0.27 | 0.00 | 0.00 | 0.00 |
| 516 | 1.000 | −172.5 | 350.0 | 633.4 | 36.16 | 0.00 | 63.57 | 0.27 | 0.00 | 0.00 | 0.00 |
| 518 | 1.000 | −172.5 | 350.0 | 271.5 | 36.16 | 0.00 | 63.57 | 0.27 | 0.00 | 0.00 | 0.00 |
| 520 | 0.987 | −193.0 | 205.0 | 633.4 | 36.16 | 0.00 | 63.57 | 0.27 | 0.00 | 0.00 | 0.00 |
| 522 | 0.000 | −266.0 | 201.0 | 633.4 | 36.16 | 0.00 | 63.57 | 0.27 | 0.00 | 0.00 | 0.00 |
| 524 | 0.000 | −221.1 | 202.0 | 699.6 | 21.43 | 0.00 | 78.22 | 0.35 | 0.00 | 0.00 | 0.00 |
| 526 | 0.219 | −258.1 | 45.0 | 699.6 | 21.43 | 0.00 | 78.22 | 0.35 | 0.00 | 0.00 | 0.00 |
| 528 | 1.000 | −241.7 | 200.0 | 205.4 | 86.32 | 0.00 | 13.68 | 0.00 | 0.00 | 0.00 | 0.00 |
| 530 | 0.000 | −280.0 | 196.0 | 205.4 | 86.32 | 0.00 | 13.68 | 0.00 | 0.00 | 0.00 | 0.00 |
| 532 | 0.169 | −307.0 | 28.0 | 205.4 | 86.32 | 0.00 | 13.68 | 0.00 | 0.00 | 0.00 | 0.00 |
| 534 | 0.000 | −271.4 | 31.0 | 635.7 | 9.55 | 0.00 | 90.07 | 0.01 | 0.00 | 0.00 | 0.00 |
| 536 | 1.000 | −307.0 | 28.0 | 269.2 | 99.00 | 0.00 | 1.00 | 0.38 | 0.00 | 0.00 | 0.00 |
| 538 | 1.000 | −210.0 | 25.0 | 269.2 | 99.00 | 0.00 | 1.00 | 0.00 | 0.00 | 0.00 | 0.00 |
| 540 | 0.994 | −234.0 | 28.0 | 635.7 | 9.55 | 0.00 | 90.07 | 0.38 | 0.00 | 0.00 | 0.00 |

respective methane concentrations of the three above-cited streams are respectively 84.80, 90.07 and 1.00 mole %. The respective nitrogen concentrations of these streams are 8.26, 9.55 and 99.00 mole %.

This example clearly illustrates the ability of the process to remove nitrogen from the open methane cycle, to produce an LNG stream, to produce a low BTU methane-rich gas stream, and to produce a high BTU methane-rich gas stream which is suitable for recycle to the liquefaction process or employment as a high quality fuel gas.

That which is claimed is:

1. A process for removing low boiling point inorganic components from a pressurized gas stream obtained from a pressurized LNG-bearing stream comprising the steps of:

(a) splitting said gas stream into a first stream and a second stream;

(b) cooling said first stream thereby producing a liquid-bearing stream;

(c) contacting said liquid-bearing stream and second stream in a countercurrent, multistage manner thereby producing a first gas stream and a liquid stream;

(d) splitting said first gas stream into a second gas stream and a third gas stream;

(e) cooling and reducing the pressure of said second gas stream thereby producing a second liquid-bearing stream;

(f) reducing the pressure of said third gas stream;

(g) contacting second liquid-bearing stream and reduced pressure third stream in a countercurrent, multistage manner thereby producing a fourth gas and a second liquid stream;

(h) cooling and reducing the pressure of said fourth gas stream thereby producing a third liquid-bearing stream;

(i) reducing the pressure of said second liquid stream;

(j) contacting said third liquid-bearing stream and reduced pressure third liquid stream in a countercurrent, multistage manner thereby producing a low BTU nitrogen-rich gas stream and a third liquid stream which upon sufficient warming becomes a high BTU methane-rich gas stream; and (k) warming said low BTU nitrogen-rich gas stream and third liquid stream by employing said streams as cooling agents for steps (e) and (h).

2. A process according to claim 1 wherein said pressurized natural gas stream is produced via a liquefaction process comprising an open methane cycle refrigeration process and further comprising the step of:

(l) combining said warmed third liquid stream of step (k) with a gas stream on the low pressure side of the first stage of methane compression.

3. A process according to claim 2 further comprising (m) reducing the pressure of said liquid stream of (c); and (n) warming said stream of (m) by employing said stream as a cooling agent for step (b).

4. A process according to claim 3 further comprising:

(o) combining said stream of step (n) with a gas stream on the low pressure side of a methane compression stage in the open methane cycle refrigeration process.

5. A process according to claim 4 wherein said open methane cycle refrigeration process employs three stages of compression and said combining of step (o) is with a gas stream on the low pressure side of the second stage of methane compression.

6. A process according to claim 5 wherein said liquefaction process comprising an open methane cycle refrigeration process is further comprised of a least two closed cycle refrigeration processes and wherein said refrigeration processes are interconnected in a cascaded manner.

7. A process according to claim 6 wherein two closed cycle refrigeration processes are employed and wherein one closed cycle employs a refrigerant consisting essentially of propane and the second closed cycle employs a refrigerant selected from the group consisting essentially of ethane, ethylene and mixtures thereof.

8. A process according to claim 1 wherein the pressures of said gas streams of step (c) are about 145 psia to 300 psia and the pressures of the streams of step (j) are less than 40 psia.

9. A process according to claim 8 wherein the pressure of the warmed stream of step (n) is about 45 psia to 80 psia.

10. A process according to claim 7 wherein the pressures of said gas streams of step (c) are 145 psia to 300 psia and the pressures of the streams of step (j) are less than 40 psia.

11. A process according to claim 10 wherein the pressure of the warmed stream of step (n) is about 45 psia to 80 psia.

12. A process according to claim 1 wherein the low boiling inorganic components are selected from the group consisting of nitrogen, helium and mixtures thereof.

13. A process according to claim 7 wherein the low boiling inorganic components are selected from the group consisting of nitrogen, helium and mixtures thereof.

14. A process according to claim 11 wherein the low boiling inorganic components are selected from the group consisting of nitrogen, helium and mixtures thereof.

15. A process according to claim 1 wherein the low boiling point inorganic components in the low BTU nitrogen-rich gas stream consist essentially of nitrogen.

16. A process according to claim 7 wherein the low boiling point inorganic components in the low BTU nitrogen-rich gas stream consist essentially of nitrogen.

17. A process according to claim 11 wherein the low boiling point inorganic components in the low BTU nitrogen-rich gas stream consist essentially of nitrogen.

18. In a cascaded refrigeration process for liquefying natural gas employing a closed two- or three-stage propane refrigeration cycle, a closed two- or three-stage ethane or ethylene refrigeration cycle and an open methane refrigeration cycle employing three stages of compression, the improvement concerns a method of removing low boiling point inorganic compounds from the open methane cycle comprising the steps of:

(a) splitting said flash gas stream from the first pressure reduction stage in the open methane cycle into a recycle stream which is ultimately return to the methane compressor and a process stream;

(b) splitting said process stream into a first stream and a second stream;

(c) cooling said first stream thereby producing a liquid-bearing stream;

(d) contacting said liquid-bearing stream and second stream in a countercurrent, multistage manner thereby producing a first gas and a liquid stream;

(e) splitting said first gas stream into a second gas stream and a third gas stream;

(f) cooling and reducing the pressure of said second gas stream thereby producing a second liquid-bearing stream;

(g) reducing the pressure of said third gas stream;

(h) contacting said second liquid-bearing stream and reduced pressure third stream in a countercurrent, multistage manner thereby producing a fourth gas and a second liquid stream;

(i) cooling and reducing the pressure of said fourth gas stream thereby producing a third liquid-bearing stream;

(j) reducing the pressure of said second liquid stream;

(k) contacting said third liquid-bearing stream and reduced pressure third liquid stream in a countercurrent, multistage manner thereby producing a low BTU nitrogen-rich gas stream and a third liquid stream which upon sufficient warming becomes a high BTU methane-rich gas stream;

(l) warming said gas stream of (k) and third liquid stream by employing said streams as cooling agents for steps (f) and (i);

(m) combining said warmed third liquid stream of step (j) with a gas stream on the low pressure side of the first stage of methane compression;

(n) reducing the pressure of said liquid stream of (d);

(o) warming said stream of (n) by employing said stream as a cooling agent for step (c); and (p) combining said stream of step (o) with a gas stream on the low pressure side of the second stage of methane compression.

19. A process according to claim 18 wherein the pressure of said pressurized natural gas stream is about 145 psia to 300 psia and the pressures of the streams of step (k) are less than 40 psia.

20. A process according to claim 19 wherein the pressure of the warmed stream of step (o) is about 45 psia to 80 psia.

21. A process according to claim 18 wherein the low boiling inorganic components are selected from the group consisting of nitrogen, helium and mixtures thereof.

22. A process according to claim 20 wherein the low boiling inorganic components are selected from the group consisting of nitrogen, helium and mixtures thereof.

23. A process according to claim 18 wherein the low boiling point inorganic components consist essentially of nitrogen.

24. A process according to claim 20 wherein the low boiling point inorganic components consist essentially of nitrogen.

25. A process for removing low boiling point inorganic components from a pressurized LNG-bearing stream comprising the steps of:

(a) splitting said stream into at least a first stream and a second stream;

(b) cooling and reducing the pressure of said first stream;

(c) reducing the pressure of said second stream;

(d) contacting said cooled and reduced pressure first stream and reduced pressure second stream in a countercurrent, multistage manner thereby producing a first gas and a liquid stream;

(e) splitting said first gas stream into a second gas stream and a third gas stream;

(f) cooling and reducing the pressure of said second gas stream thereby producing a liquid-bearing stream;

(g) reducing the pressure of said third gas stream;

(h) contacting said liquid-bearing stream and reduced pressure third stream in a countercurrent, multistage manner thereby producing a fourth gas and a second liquid stream;

(i) cooling and reducing the pressure of said fourth gas stream thereby producing a second liquid-bearing stream;

(j) reducing the pressure of said second liquid stream;

(k) contacting said second liquid-bearing stream and reduced pressure third liquid stream in a countercurrent, multistage manner thereby producing a low BTU nitrogen-rich gas stream and a third liquid stream which upon sufficient warming becomes a high BTU methane-rich gas stream; and (l) warming said gas stream of (k) and third liquid stream by employing said streams as cooling agents for steps (f) and (i).

26. A process according to claim 25 wherein said pressurized LNG-bearing stream is produced via a liquefaction process comprising an open methane cycle refrigeration process and further comprising the step of:

(m) combining said warmed third liquid stream of step (l) with a flash gas stream on the low pressure side of the first stage of methane compression.

27. A process according to claim 26 wherein the open methane cycle refrigeration process employs three stages of compression.

28. A process according to claim 27 wherein said liquefaction process comprising an open methane cycle refrigeration process is further comprised of a least two closed cycle refrigeration processes and wherein said refrigeration processes are interconnected in a cascaded manner.

29. A process according to claim 28 wherein two closed cycle refrigeration processes are employed and wherein one closed cycle employs a refrigerant consisting essentially of propane and the second closed cycle employs a refrigerant selected from the group consisting essentially of ethane, ethylene and mixtures thereof.

30. A process according to claim 29 wherein the pressure of the pressurized LNG-bearing stream is at least 500 psia and the pressures of said streams produced of step (d) are about 300 psia to about 500 psia.

31. A process according to claim 30 wherein the pressures of the streams of step (k) are less than 40 psia.

32. A process according to claim 25 wherein the low boiling point inorganic components are selected from the group consisting of nitrogen, helium and mixtures thereof.

33. A process according to claim 31 wherein the low boiling point inorganic components are selected from the group consisting of nitrogen, helium and mixtures thereof.

34. A process according to claim 25 wherein the low boiling point inorganic components consist essentially of nitrogen.

35. A process according to claim 31 wherein the low boiling point inorganic components consist essentially of nitrogen.

36. In a cascaded refrigeration process for liquefying natural gas employing a closed two- or three-stage propane refrigeration cycle, a closed two- or three-stage ethane or ethylene refrigeration cycle and an open methane refrigeration cycle employing three stages of compression, the improvement concerns a method of removing low boiling point inorganic components from the methane cycle comprising the steps of;

(a) splitting the pressurized LNG-bearing stream from the final stage of ethylene cooling into at least a first stream, a second stream, and one or more other streams to be conventionally flashed to near-atmospheric pressure;

(b) cooling and reducing the pressure of said first stream thereby producing a liquid-bearing stream;

(c) reducing the pressure of said second stream;

(d) contacting said liquid-bearing stream and reduced pressure second stream in a countercurrent, multistage manner thereby producing a first gas and a liquid stream;

(e) splitting said first gas stream into a second gas stream and a third gas stream;

(f) cooling and reducing the pressure of said second gas stream thereby producing a second liquid-bearing stream;

(g) reducing the pressure of said third gas stream;

(h) contacting said second liquid-bearing stream and reduced pressure third stream in a countercurrent, multistage manner thereby producing a fourth gas and a second liquid stream;

(i) cooling and reducing the pressure of said fourth gas stream thereby producing a third liquid-bearing stream;

(j) reducing the pressure of said second liquid stream;

(k) contacting said third liquid-bearing stream and reduced pressure third liquid stream in a countercurrent, multistage manner thereby producing a low BTU nitrogen-rich gas, and a third liquid stream which upon sufficient warming becomes a high BTU methane-rich gas stream;

(l) warming said fifth gas stream and third liquid stream by employing said streams as cooling agents for steps (f) and (i); and (m) combining said warmed third liquid stream of step (l) with a gas stream on the low pressure side of the first stage of methane compression.

37. A process according to claim 36 wherein the pressure of the LNG-bearing stream is at least 500 psia and said pressures of said streams of step (d) are about 300 psia to about 500 psia.

38. A process according to claim 37 wherein the pressure of the streams of step (k) is less than 40 psia.

39. A process according to claim 36 wherein the low boiling point inorganic components are selected from the group consisting of nitrogen, helium and mixtures thereof.

40. A process according to claim 38 wherein the low boiling point inorganic components are selected from the group consisting of nitrogen, helium and mixtures thereof.

41. A process according to claim 36 wherein the low boiling point inorganic components consist essentially of nitrogen.

42. A process according to claim 38 wherein the low boiling point inorganic components consist essentially of nitrogen.

43. An apparatus for removing low boiling point inorganic compounds from a pressurized hydrocarbon-rich gas stream comprising:

(a) first and second splitting means;

(b) first, second, third, fourth, fifth and sixth indirect heat exchange means;

(c) first, second and third stripper columns;

(d) first, second and third pressure reduction means;

(e) a first conduit connected to the first splitting means;

(f) a second conduit connected between the first splitting means and the inlet to the first indirect heat exchange means;

(g) a third conduit connected to the outlet of the first indirect heat exchange means and the upper section of the first stripper column;

(h) a fourth conduit connected to the first splitting means and the lower section of the first stripper column;

(i) a fifth conduit connected to the bottom of the first stripper column and the first pressure reduction means;

(j) a sixth conduit connected to the first pressure reduction means and the inlet to the second indirect heat exchange means wherein the first heat exchange means is situated in close proximity to the first indirect heat exchange means so as to provide for heat exchange between the two means;

(k) a seventh conduit connected to the outlet of the second indirect heat exchange means;

(l) an eighth conduit connected to the top of the first stripper column and the second splitting means;

(m) a ninth conduit connected between the second splitting means and the inlet to the third indirect heat exchange means;

(n) a tenth conduit connected to the outlet of the third indirect heat exchange means and the upper section of the second stripper column;

(o) an eleventh conduit connected to the second splitting means and the upper section of the second stripper column;

(p) a twelfth conduit connected to the top of the second stripper column and the inlet to the fourth indirect heat exchange means;

(q) a thirteenth conduit connected to the outlet of the fourth indirect heat exchange means and the third pressure reduction means;

(r) a fourteenth conduit connected to the third pressure reduction means and the upper section of the third stripper column;

(s) a fifteenth conduit connected to the bottom of the second stripper column and the second pressure reduction means;

(t) a sixteenth conduit connected to the second pressure reduction means and the lower section of the third stripper column;

(u) a seventeenth conduit connected to the top of the third stripper column and the inlet to the fifth indirect heat exchange means;

(v) an eighteenth conduit connected to the bottom of the third stripper column and the inlet to the sixth indirect heat exchange means;

(w) a nineteenth conduit connected to the outlet of the fifth indirect heat exchange means; and (x) a twentieth conduit connected to the outlet of the sixth indirect heat exchange means;

wherein said third and fourth indirect heat exchange means are situated in sufficiently close proximity to the fifth and sixth indirect heat exchange means so as to provide for heat exchange.

44. An apparatus according to claim 43 further comprising:

(y) a three stage methane compressor wherein the inlet to the first stage of compression is connected to the seventh conduit and the inlet to the second stage of compression is connected to the twentieth conduit.

45. An apparatus according to claim 44 wherein said three stage methane compressor is employed in a cascaded refrigeration process for liquefying natural gas.

46. An apparatus for removing low boiling point inorganic components from a pressurized LNG-bearing stream comprising:

(a) first and second splitting means;

(b) first, second, third, fourth, and fifth indirect heat exchange means;

(c) a fuel column;

(d) first and second stripper columns;

(e) first, second third, fourth, fifth and sixth pressure reduction means;

(f) a first conduit connected to the first splitting means;

(g) a second conduit connected between the first splitting means and the inlet to the first indirect heat exchange means;

(h) a third conduit connected to the outlet of the first indirect heat exchange means and the first pressure reduction means;

(i) a fourth conduit connected to the first pressure reduction means and the fuel column;

(j) a fifth conduit connected to the first splitting means and the second pressure reduction means;

(k) a sixth conduit connected to the second pressure reduction means and the lower section of the fuel column;

(l) a seventh conduit connected to the bottom of the fuel column;

(m) an eighth conduit connected to the top of the fuel column and to the second splitting means;

(n) a ninth conduit connected to the second splitting means and the third pressure reduction means;

(o) a tenth conduit connected to the second splitting means and inlet to the second indirect heat exchange means;

(p) an eleventh conduit connected to the outlet to the second indirect heat exchange means and the upper section of the first stripper column;

(q) a twelfth conduit connected between the second splitting means and the lower section of the first stripper column;

(r) a thirteenth conduit connected to the top of the first stripper column and the inlet to the third indirect heat exchange means;

(s) a fourteenth conduit connected to the outlet to the third indirect heat exchange means and the fifth pressure reduction means;

(t) a fifteenth conduit connected to the fifth pressure reduction means and the upper section of the second stripper column;

(u) a sixteenth connected to the bottom of the first stripper column and the fourth pressure reduction means;

(v) a seventeenth conduit connected to the fourth pressure reduction means and the lower section of the second stripper column;

(w) an eighteenth conduit connected to the top of the second stripper column and the inlet to the fourth indirect heat exchange means;

(x) a nineteenth conduit connected to the bottom of the second stripper column and the inlet to the fifth indirect heat exchange means;

(y) a twentieth conduit connected to the outlet of the fourth indirect heat exchange means; and (z) a twenty-first conduit connected to the outlet of the fifth indirect heat exchange means;

wherein said second and third indirect heat exchange means are situated in sufficiently close proximity to the fourth and fifth indirect heat exchange means so as to provide for heat exchange.

47. An apparatus according to claim 46 further comprising:

(aa) a multistage methane compressor wherein the inlet to the first stage of compression is connected to the twenty-first conduit.

48. An apparatus according to claim 47 wherein said multistage methane compressor is employed in a cascaded refrigeration process for liquefying natural gas.

* * * * *

UNITED STATES PATENT AND TRADEMARK OFFICE

CERTIFICATE OF CORRECTION

PATENT NO. :6,070,429

DATED :June 6, 2000

INVENTOR(S) :William R. Low and Jame Yao

It is certified that error appears in the above-indentified patent and that said Letters Patent is hereby corrected as shown below:

Claim 18, column 29, line 64, please delete "step (j)" and insert therefore ---step (l)---.

Signed and Sealed this

Tenth Day of April, 2001

*Attest:*

Nicholas P. Godici

NICHOLAS P. GODICI

*Attesting Officer*

*Acting Director of the United States Patent and Trademark Office*